US011891879B2

(12) United States Patent
Manning

(10) Patent No.: US 11,891,879 B2
(45) Date of Patent: Feb. 6, 2024

(54) PRESSURE ACTUATED DOWNHOLE DEVICE

(71) Applicant: Pragma Well Technology Limited, Aberdeen (GB)

(72) Inventor: Matthew Manning, Alford (GB)

(73) Assignee: PRAGMA WELL TECHNOLOGY LIMITED, Aberdeen (GB)

( * ) Notice: Subject to any disclaimer, the term of this patent is extended or adjusted under 35 U.S.C. 154(b) by 154 days.

(21) Appl. No.: 17/425,585

(22) PCT Filed: Jan. 24, 2020

(86) PCT No.: PCT/GB2020/050169

§ 371 (c)(1),
(2) Date: Jul. 23, 2021

(87) PCT Pub. No.: WO2020/152478

PCT Pub. Date: Jul. 30, 2020

(65) Prior Publication Data

US 2022/0090467 A1 Mar. 24, 2022

(30) Foreign Application Priority Data

Jan. 25, 2019 (GB) ..... 1901047

(51) Int. Cl.
*E21B 34/08* (2006.01)
*E21B 34/14* (2006.01)
(Continued)

(52) U.S. Cl.
CPC ..... *E21B 34/08* (2013.01); *E21B 34/101* (2013.01); *E21B 34/142* (2020.05); *E21B 43/127* (2013.01);
(Continued)

(58) Field of Classification Search
CPC .... E21B 34/08; E21B 34/101; E21B 2200/05; E21B 2200/06; E21B 33/00
See application file for complete search history.

(56) References Cited

U.S. PATENT DOCUMENTS 3,860,066 A 1/1975 Pearce et al.
3,880,066 A 4/1975 Ruget
(Continued)

FOREIGN PATENT DOCUMENTS

CA 2963180 A1 4/2016
EP 1359289 A1 11/2003
(Continued)

OTHER PUBLICATIONS

Intellectual Property Office, Search Report received for Application No. GB1901047.9, dated Jun. 3, 2019, 4 pages, UK.
(Continued)

*Primary Examiner* — David Carroll
(74) *Attorney, Agent, or Firm* — Alston & Bird LLP

(57) ABSTRACT

A downhole valve, such as a safety valve or sub-sea safety valve (SSSV). The downhole valve comprising: a housing; a flow path between a valve inlet and a valve outlet; a valve mechanism; and a piston member; wherein the valve mechanism is operable by actuation of the piston member to selectively open and close the flow path between the valve inlet and valve outlet; and the piston member is actuatable by a pressure differential between an annulus pressure at the valve and a pressure at the valve outlet and/or in a portion of the flow path closest to the valve outlet. The valve can comprise an opening for receiving the annular pressure that is isolated from the valve inlet and valve outlet. The downhole valve can be configured such that it prevents operation
(Continued)

of the valve mechanism to open and/or close the flow path by a pressure differential between the valve inlet and valve outlet.

28 Claims, 11 Drawing Sheets

(51) Int. Cl.
*E21B 34/10* (2006.01)
*E21B 43/12* (2006.01)

(52) U.S. Cl.
CPC ..... *E21B 2200/04* (2020.05); *E21B 2200/05* (2020.05); *E21B 2200/06* (2020.05)

(56) References Cited

U.S. PATENT DOCUMENTS 4,518,036 A * 5/1985 Lefebvre ..... E21B 34/08 166/321
4,537,258 A * 8/1985 Beck ..... E21B 49/001 166/374
10,100,605 B2 10/2018 Gay et al.
2003/0121665 A1 * 7/2003 Trott ..... E21B 34/10 166/332.8

FOREIGN PATENT DOCUMENTS

GB 2217753 A 11/1989
WO WO 2009/132462 A1 11/2009

OTHER PUBLICATIONS

International Searching Authority, International Search Report and Written Opinion received for International Application No. PCT/GB2020/050169, dated Jun. 26, 2020, 17 pages, European Patent Office, Netherlands.
The International Bureau of WIPO, International Preliminary Report on Patentability Chapter I received for International Application No. PCT/GB2020/050169, dated Aug. 5, 2021, 13 pages, Switzerland.

* cited by examiner

PRESSURE ACTUATED DOWNHOLE DEVICE

CROSS REFERENCE TO RELATED APPLICATIONS

This application is a National Stage Application, filed under 35 U.S.C. 371, of International Application No. PCT/GB2020/050169, filed Jan. 24, 2020, which international application claims priority to and the benefit of Great Britain Application No. 1901047.9, filed Jan. 25, 2019; the contents of both of which as are hereby incorporated by reference in their entireties.

BACKGROUND

Related Field

The present invention relates to a pressure actuated downhole device, particularly but not exclusively to a downhole value such as a downhole safety valve.

Related Art

Oil and gas operations employ a plurality of downhole tools. Such tools may be deployed within the wellbore temporarily to support temporary operations such as perforating, or may be run as part of a well pipe in wellbore completions to allow long-term repetitive operations.

In some instances, as for example in the case of a tool which is temporarily deployed within a wellbore to perform a certain operation, activation of the tool should occur at a precise location within the wellbore. Various tools and mechanisms can be used for the activation of downhole tools.

Cable deployed pumps, such as electric submersible pumps (ESPs), require a control line to the surface that generally sits inside the production tubing. A motor part of the pump is typically provided downhole of the rest of the pump mechanism. As a result, running communication lines for controlling tools that are downhole of the pump can be problematic. An example of this is controlling a valve, particularly a sub-sea safety valve (SSSV). The valve may conventionally be controllable by a control line such as a hydraulic line or an electrical line, for example. However, running such a control line for a valve past the pump may be problematic. In addition, use of an ESP control line in itself can be problematic and may require use of sealing mechanisms in devices located above the ESP to accommodate the ESP control line. For example, a SSSV located uphole of the ESP may seal in a wireline nipple profile that has the ESP control line passing through it, through a seal assembly. This arrangement may not be desirable.

This issue is not limited to apparatus requiring electric cables, such as ESPs, and could also arise with other well service activities that require some form of conduit or line to be installed across a valve. Examples of conduits or lines include tubing including coiled tubing, fibreglass/plastic tubing, metal reinforced elastomeric tubing or solid rods. Examples of applications that require tubing for pump through capability include velocity strings, siphon strings, amongst others. Conduits can also be used in combination with other artificial lift technology such as jet pumps and hydraulic submersible pumps. Solid rods could be used for rod lift or progressive cavity pump retrofit systems. Applications that require placement of a conduit or line across an existing safety valve could render it inoperable, and operating under such conditions would not be allowable in many jurisdictions.

BRIEF SUMMARY

One or more aspects may be defined by the independent claims. One or more preferred features may be defined by the dependent claims.

A first aspect of the present disclosure is directed to a pressure actuated downhole device, such as a valve, e.g. a safety valve or sub-sea safety valve (SSSV), the downhole device being configured for use downhole. The downhole device may comprise a housing. The downhole device may comprise a flow path between a valve inlet and a valve outlet, which may be at least partially defined by the housing. The downhole device may comprise at least one valve mechanism, which may be located within the housing. The downhole device may comprise at least one piston member, which may be located within the housing. The at least one valve mechanism may be operable by actuation of the piston member or members, e.g. to selectively open and close the flow path between the valve inlet and valve outlet. The piston member or members may be configured so as to be actuatable by a pressure differential, such as a pressure differential between a pressure external to the device and a pressure internal to the device. The pressure external to the device may be a pressure in an annulus or a pressure at a valve inlet. The pressure internal to the device may be a pressure at the valve outlet and/or in a portion of the flow path closest to the valve outlet. The piston member or members may be configured so as to be actuatable by the pressure at the valve outlet and/or the pressure differential between the annulus and the pressure at the valve outlet and the piston member or members may not be actuatable by the pressure at the valve inlet alone and/or the piston member or members may be configured so that actuation of the piston member or members is unaffected by the pressure at the valve inlet.

The valve may be configured such that the at least one valve mechanism is not operable to open and/or close the flow path by, and/or the valve may be configured such that operation of the at least one valve mechanism to open and/or close the flow path is unaffected by or insensitive to, a differential between pressure downhole of the valve and pressure uphole of the valve. The valve may be configured such that the at least one valve mechanism is not operable to open and/or close the flow path by, and/or the valve may be configured such that operation of the at least one valve mechanism to open and/or close the flow path is unaffected by or insensitive to, a pressure differential between the valve inlet and valve outlet. The at least one valve mechanism may not be operable to open and/or close the flow path by a pressure differential or changes in pressure differential between the valve inlet and valve outlet, e.g. at least for operating or rated valve inlet pressures or at valve inlet pressures below a maximum operating pressure.

The annulus may extend around the tubing string and/or housing. The annulus may be or comprise a volume that is radially outwardly of the device, e.g. between the device and a wellbore wall, casing, liner or tubular in which the device is located or locatable, in use.

The valve may comprise at least one connector for connecting to one or more other devices. The valve outlet may be configured to fluidly couple to at least one of the other devices, e.g. for fluid communication therewith. The valve inlet may be may be configured to fluidly couple to at least one of the other devices, e.g. for fluid communication therewith.

The at least one connector may comprise at least a first connector for connecting to at least one of the other devices that is uphole of the valve, such as a pump or other artificial lift device. The pump or other artificial lift system may comprise an electric submersible pump (ESP), a jet pump, a capillary string, a syphon string, a velocity string, or the like. The device (e.g. the pump or other artificial lift system) may be or comprise a cable, line or conduit deployed or operated device. The valve outlet may be configured to couple and/or be in fluid communication with the other device that is uphole of the valve, e.g. to the pump or other artificial lift system, such as to a pump inlet, when the valve is connected to the other device, e.g. by the first connector. The pump or other artificial lift system may be configured to generate the pressure differential. The piston member or members may be configured so as to be actuatable by operation of the pump or other artificial lift system. The at least one valve mechanism may be operable by actuation of the piston member or members responsive to operation of the pump or other artificial lift system to selectively open and close the flow path between the valve inlet and valve outlet. The valve may be configured such that the valve is open or opens when operation of the pump or other artificial lift system is above a threshold (e.g. such that a pressure differential between the annulus and the valve outlet exceeds or is greater than the threshold amount and/or so that the pressure at the valve outlet is below a certain amount). The valve may be configured such that the valve is closed or closes when operation of the pump or other artificial lift system below a threshold or when the pump or other artificial lift system is not operating (e.g. such the pressure differential between the annulus and the valve outlet is within or less than the threshold amount and/or so that the pressure at the valve outlet is above a certain amount).

The at least one connector may comprise at least a second connector for connecting to at least one of the other devices that is downhole of the valve, such as a packer, e.g. a seal bore packer. Alternatively or additionally, the pressure actuated downhole device itself may comprise a sealing mechanism, e.g. for sealing against the bore. For example, the sealing mechanism may comprise a seal bore packer or the like, which may be integral with, mounted on and/or fixed to the pressure actuated downhole device. The seal bore packer may comprise a through bore and a sealing element. The sealing element may be configured to close and/or seal the annulus, in use. The valve inlet may be configured to couple and/or be in fluid communication with the other device that is downhole of the valve, such as the packer, e.g. to the through bore of the packer, when the valve is connected to the other device, e.g. by the second connector.

The annulus may extend between radially outer surfaces of at least part of one or more of the other devices (and the housing of the valve) and the wall of the wellbore, liner, casing, or tubular.

The housing may be or comprise a tubular housing. The housing may be or comprise an elongate housing. The housing may be or comprise a cylindrical housing. The housing may be hollow.

The at least one valve mechanism and/or piston member or members may be provided within the housing. At least part of the at least one valve mechanism may be provided within the flow path.

The valve may comprise an opening configured to receive the annulus pressure, which may be isolated from the valve inlet and/or the valve outlet.

The downhole device may comprise at least one first pressure chamber, which may be in fluid communication with the annulus, e.g. via the opening. The first pressure chamber(s) may be isolated from the flow path from the valve inlet to the valve outlet.

The first pressure chamber(s) may be at least partially defined by the housing and the piston member or members. When more than one piston member is provided, then each respective piston member may be associated with a respective or common first pressure chamber and each respective or common first pressure chamber may be at least partially defined by the housing and the associated piston member. The first pressure chamber(s) may be in fluid communication with the annulus, e.g. via a respective or common opening, aperture or passage through the housing, e.g. through a portion of the housing defining the first pressure chamber so as to be open to an environment external to the valve.

The flow path from the valve inlet to the valve outlet may comprise or be comprised in a through passage, flow passage or bore that extends within, along and/or through the valve. The pressure internal to the device may be a pressure of at least part of the through passage, flow passage or bore that extends within, along and/or through the valve.

The downhole device may comprise at least one second pressure chamber, which may be in fluid communication with the valve outlet and/or with at least part of the flow path from the valve inlet to the valve outlet. The second pressure chamber(s) may be isolated from the annulus.

The second pressure chamber(s) may be at least partially defined by the housing and the piston member(s). When more than one piston member is provided, then each respective piston member may be associated with a respective or common second pressure chamber and each respective second pressure chamber may be at least partially defined by the housing and the associated piston member. The second pressure chamber(s) may be in fluid communication with the valve outlet and/or flow path, e.g. via a respective or common opening, aperture or passage through the housing, e.g. through a portion of the housing defining the second pressure chamber(s), to the valve outlet and/or flow path.

The first and second pressure chambers may be separated by the piston member(s). When more than one piston member and more than one second pressure chamber are provided, then each respective first and second pressure chamber may be separated by the respective associated piston member. The piston member may comprise at least one piston seal. The at least one piston seal may seal between the piston member and the housing. The at least one piston seal may provide a seal between the first pressure chamber and the second pressure chamber.

When more than one piston member and more than one second pressure chamber are provided, then each piston member may be configured to be operated by different pressure differentials or substantially the same pressure differential, e.g. by providing an appropriate piston size, diameter or area, and/or opening, aperture or passage size, seal friction and/or the like. Each piston member may be connected axially. It will be appreciated that the piston members may be provided in a parallel between the annulus and the value outlet, where each piston member may be provided between the annulus and the valve outlet. Each piston member may provide a "stage" of a multi-stage piston arrangement. This arrangement may be used to increase the total piston area, which may increase the force actuating the pressure operated device and may more readily overcome any seal friction. The piston members may be configured such that different piston members are actuatable by different pressure differentials or valve outlet pressures.

The valve mechanism may be integral with the piston member(s). The valve mechanism may be coupled or connected (e.g. directly connected) to the piston member(s). The valve mechanism may be configured to move with the piston member (e.g. with the actuation of the piston member or responsive to movement or actuation of the piston member). When a plurality of valve mechanisms are provided then each valve mechanism may be integral, coupled or connected to respective piston member(s) and/or configured to move with the respective piston member(s). One or more piston members and/or one or more valve mechanisms may be integral, coupled or connected together for movement together in tandem.

The valve may comprise at least one biasing means such as a spring, resiliently deformable member, and/or the like. The biasing means may be configured to bias the piston member towards one end of its range of motion. The biasing means may be configured to bias the piston member against the pressure from the annulus. In an alternative arrangement, the biasing means may be configured to bias the piston member against the pressure at the valve outlet. The biasing means may be configured to bias the valve mechanism into the closed configuration.

The biasing means may be configured to bias the valve mechanism or mechanisms towards or against the pressure at the inlet or against being operated by a pressure differential between the valve inlet and valve outlet. With the above arrangement, it may be possible to more surely prevent operation of the valve by changes in differential pressure between the valve inlet and valve outlet.

The valve mechanism (or one or more or each of the valve mechanisms when a plurality of valve mechanisms are provided) may be or comprise a sliding sleeve, a poppet, a ball, a flapper, a knife edge valve, and/or the like. The valve may comprise at least one valve seat. The valve seat may be formed from a polymeric material or a polymeric material comprising a filler, such as but not limited to ceramic filled PTFE or polyether ether ketone (PEEK). The valve seat may be formed from a softer material than a part of the valve that engages it to close the valve. The valve seat may be formed from a metal or metallic compound, a ceramic or the like. The valve mechanism or respective valve mechanisms may be operable to selectively engage and/or seal with the valve seat or with respective valve seats in order to close the flow path. The valve mechanism(s) may be operable to selectively disengage and/or break a seal with the valve seat(s) in order to open the flow path.

The valve mechanism or respective valve mechanisms may comprise a sealing surface which may be engageable with the valve seat or with respective valve seats to seal against the valve seat to close and/or seal the flow path.

The valve mechanism(s) may comprise a valve inlet end surface that is towards the valve inlet or packer in use or downhole. The valve mechanism(s) may comprise a valve outlet end surface that is arranged towards the valve outlet or pump in use or uphole. The valve outlet end surface may be arranged towards the pump and the valve inlet end surface may be arranged away from the pump. The valve inlet end surface of the valve mechanism may have a smaller area than the valve outlet end surface, e.g. by a factor of at least 1.25, 1.5, 2, 3, 4 or more. The valve mechanism(s) may comprise a sloping face. The sloping face may extend obliquely radially outwardly from the valve inlet end surface of the valve mechanism(s). The sloping face may be provided between the valve inlet end surface and the valve outlet end surface. The sloping face may be angled, oblique or sloping with respect to the flow path and/or the direction of flow in the flow path.

The valve mechanism(s) may comprise a sub-chamber, which may be located behind the inlet end face and/or the sloping face and/or within the valve mechanism(s). The sub-chamber may be in fluid communication with a downstream or uphole or annulus pressure, e.g. via the first pressure chamber.

With the above arrangement, it may be possible to more surely prevent operation of the valve by changes in differential pressure between the valve inlet and valve outlet.

The downhole device may be a bidirectional downhole device, such as a bidirectional valve. The downhole device may be remotely operable, e.g. to selectively open or close the flow path between the valve inlet and valve outlet. The downhole device may be remotely operable by pressure supplied from uphole of the downhole device, e.g. from the surface. The downhole device may be remotely operable by pressure supplied from uphole of the downhole device, e.g. from the surface, into a configuration in which the downhole device allows fluid flow through the downhole device from uphole to downhole and operable by operation of the pump into a configuration in which the downhole device allows fluid flow through the downhole device from downhole to uphole.

The downhole device may comprise at least two operating mechanisms that are operable to configure the downhole device to selectively open or close the flowpath. One of the operating mechanisms (a main operating mechanism) may comprise the piston member or members operable by the pressure differential between the pressure in the annulus or valve inlet and the pressure at the valve outlet and/or in a portion of the flow path closest to the valve outlet.

The other operating mechanism may be configured to receive pressure from a remote location, such as a surface or other uphole location, and may be operable by the pressure from the remote location to selectively open or close the flowpath.

The other operating mechanism may comprise a shuttle sleeve. The other operating mechanism may comprise a plurality of seals, which may be unidirectional seals, which may be provided on the shuttle sleeve. The unidirectional seals of the other operating mechanism may be arranged to selectively seal against flow in different directions, e.g. in opposite directions. The plurality of seals may seal between the housing and the valve mechanism. The other operating mechanism may comprise biasing means, e.g. for biasing the shuttle sleeve against the pressure from the remote (e.g. surface) location. One of the plurality of seals may be provided at one end of the shuttle sleeve and the other of the plurality of seals may be provided at the other end of the shuttle sleeve. One of the plurality of unidirectional seals may be arranged to restrict downhole or well pressure. The other of the plurality of seals may be arranged to restrict pressure from the remote location, e.g. uphole pressure.

The other operating mechanism may be subject to a pressure differential between the pressure from the remote (e.g. uphole or surface) location and the pressure downhole, e.g. at the valve inlet or second connector. The pressure from the remote location may be or comprise the pressure internal to the downhole device, e.g. in a bore through the downhole device. The pressure from the remote location may comprise a pressure provided through the pump or a separate pressure line. The seal at the one end of the shuttle sleeve may be arranged to receive pressure from the remote (e.g. surface) location. The seal at the other end of the shuttle sleeve may be arranged to receive the pressure from downhole, the valve inlet, and/or second connector.

The other operating mechanism may be configured such that pressure received by the other operating mechanism from downhole, e.g. from the valve inlet or second connector, may be operable to force the shuttle sleeve towards and/or onto a load surface on the housing.

The other operating mechanism may be configured such that pressure received by the other operating mechanism from the remote location may be operable to force the shuttle sleeve towards and/or onto a load surface on or coupled to the at least one valve mechanism and/or the piston member or members.

The downhole device may be configured such that pressure received by the other operating mechanism from downhole, the valve inlet or second connector, acts across a differential piston area between the seal diameter of the at least one valve mechanism and an effective diameter or inner diameter of the seal of the other operating mechanism that receives the pressure from downhole, the valve inlet and/or second connector.

The effective diameter or inner diameter of the seal of the other operating mechanism that receives the pressure from downhole, the valve inlet and/or second connector may be less than the seal diameter of the at least one valve mechanism. For example, the effective diameter or inner diameter of the seal of the other operating mechanism that receives the pressure from downhole, the valve inlet or second connector may be less than 100% but greater than 75%, greater than 90% or greater than 95% of the seal diameter of the at least one valve mechanism.

The downhole device may be configured such that pressure received by the other operating mechanism from the remote location acts across a differential piston area between the seal diameter of the at least one valve mechanism and an effective diameter or outer diameter of the seal of the other operating mechanism that receives the pressure from the remote location. For example, the effective diameter or outer diameter of the seal of the other operating mechanism that receives the pressure from the remote location may be greater than the seal diameter of the at least one valve mechanism. The effective diameter or outer diameter of the seal of the other operating mechanism that receives the pressure from the remote location may be less than 5% greater, less than 10% greater or less than 25% greater than the seal diameter of the at least one valve mechanism.

In this way, the sealing of the valve mechanism is boosted regardless of which way the pressure differential is applied to the other operating mechanism. The above mechanism also allows the downhole device to be opened and/or tested by applying pressure from a remote location (e.g. from uphole, generally from the surface). The relative ratios of diameters of the seals of the other operating mechanism and the sealing diameter of the at least one valve mechanism may mean that the sealing of the valve mechanism is boosted but that the other operating mechanism presents a low barrier to opening of the valve using the main operating mechanism. The above arrangement also allows the valve to be bi-directional and open up its potential for use in a range of applications such as a fluid loss valve or a barrier valve.

The downhole device may comprise an opening mechanism configured to open when a threshold pressure differential is provided across it, e.g. due to pressure applied from the remote location. The opening mechanism may be provided between the first connector at the uphole end of the device or an interior of the downhole device and the second connector at the downhole end of the downhole device. The opening device may comprise at least one of: a burst disc, a sealed plug, a seal member attached with shear screws, a shear ring, a detent ring, a detent spring and/or the like. The opening device may be configured such that opening or bursting the opening device may allow access between the first and second connectors and/or the uphole and downhole ends of the downhole device.

At least part of the valve mechanism(s) (which may be or comprise a poppet), such as a part of the valve mechanism comprising the valve inlet end surface and the sloping face, may be conical or frusto-conical.

The valve mechanism(s) (which may be or comprise a sliding sleeve) may define a through passage from an inlet end of the valve mechanism to an outlet end of the valve mechanism. The valve (e.g. the housing) may define a feed passage in fluid communication with the valve inlet, e.g. to receive fluid therefrom, in use. The feed passage may comprise a feed passage inlet that is in fluid communication with the valve inlet and a feed passage outlet at an end of the feed passage opposite the feed passage inlet. The feed passage outlet may be configured to face a side wall of the valve mechanism (e.g. of the sliding sleeve) when the valve mechanism is in a closed configuration. The valve mechanism (e.g. the sliding sleeve) may be configured to close and/or seal the feed passage outlet when the valve mechanism is in a closed configuration. The feed passage may be configured such that at least the feed passage outlet and/or a portion of the feed passage immediately adjacent the feed passage outlet and/or the flow of fluid therein is perpendicular, angled or oblique to a direction of motion of the valve mechanism.

The pressure actuated downhole device may comprise more than one valve mechanism, wherein each valve mechanism may comprises a respective sealing surface that may be configured to seal against a respective valve seat and may further comprise or be coupled with, and/or operable by, at least one respective associated piston member. The valve may be configured such that the pressure at the valve inlet acts on at least one of the piston member(s) to seat and/or seal the at least one of the valve mechanism. The valve may be configured such that the pressure at the valve inlet acts on at least one other of the piston member(s) so as to oppose a force applied by the at least one biasing means and/or acts to unseat and/or unseal the at least one other or different valve mechanism. The valve may be configured such that the pressure at the valve inlet acts on the at least one piston member so as to oppose the action of the valve inlet on the at least one other piston member.

The at least one piston member may be configured to provide the same or substantially the same piston area or diameter on its valve inlet side as the at least one other piston member, or at least any differential in piston area or diameter on the valve inlet side between the at least one piston member and the at least one other piston member may be such that any difference in force applicable by the fluid inlet pressure to the at least one piston member and the at least one other piston member is less than a biasing force applied by the biasing member. The at least one piston member may be configured to provide a different, e.g. smaller, piston area or diameter on its valve outlet side then the at least one other piston member. In this way, the valve may be operable between open and closed configurations to open and close the fluid path responsive to changes in the pressure at the valve outlet, e.g. provided by the pump or other artificial lift system, but may not operable and/or is unaffected by the pressure applied at the fluid inlet alone.

With the above arrangement, it may be possible to more surely prevent operation of the valve by changes in differential pressure between the valve inlet and valve outlet.

When in the closed configuration, the valve mechanism may be configured such that the through passage of the valve mechanism is closed and/or sealed or otherwise not in fluid communication with the feed passage. When in the open configuration, the valve mechanism may be configured such that the through passage within the valve mechanism is open and/or otherwise be in fluid communication to the feed passage.

The seal bore packer may define a through bore. The seal bore packer may comprise a support member, which may be or comprise a hollow tubular member, which may define the through bore. The packer may comprise a sealing element for sealing between the support member and the wall of the wellbore, casing, liner or outward tube. The annulus may be at least partly defined by the packer, valve and/or pump. At least part of the annulus may be provided between an outer surface of at least part of the valve and/or pump and the wall of the wellbore, casing, liner or tubular. The sealing element of the packer may close or selectively close the annulus.

The pump may comprise a hollow pump housing, such as a tubular housing, and a pump mechanism. The pump may define a flow path between a pump inlet and a pump outlet. The pump mechanism may be configured to pump fluid along the flow path, e.g. between the pump inlet and the pump outlet such as from the pump inlet to the pump outlet. The pump outlet may be configured to be in fluid communication with the annulus. The pump inlet may be configured to be coupled to or in fluid communication with the valve outlet. The pump may be configured to generate a positive pressure differential between the pump inlet and the pump outlet in use (i.e. the pressure at the pump inlet may be lower than the pressure at the pump outlet). The pump may be operable to increase the pressure in the annulus and/or in the first pressure chamber of the valve. The pump may be operable to decrease the pressure at the valve outlet, in the valve bore and/or in the second pressure chamber of the valve.

The pump may comprise at least one connector. The pump housing may define part of the annulus, e.g. the annulus may extend radially from an exterior surface of the pump housing such as between the pump housing and the wall of the wellbore, liner, casing or tubular in which the pump is provided, in use.

The pump inlet may be configured for fluid connection to the flow path within the valve, e.g. to the valve outlet. The pump outlet may be configured for fluid connection to the annulus. The pump may be configured to pump fluid from the flow path in the valve, the second pressure chamber and/or the valve outlet to the annulus.

The pump may be configured so as to generate and/or vary the pressure differential between the annulus and at least part of the flow path within the valve and/or the valve outlet. The pump may be configured so as to generate and/or vary the pressure differential between the first pressure chamber and the second pressure chamber.

When the pump is in operation, it may suck fluid through the pump inlet and expel the fluid from the pump outlet, which may cause a drop in pressure of the pump inlet with respect to the pump outlet and may cause an increase in pressure at the pump outlet with respect to the pump inlet. As the outlet of the pump may be in fluid communication with the annulus (e.g. the pump is arranged to expel fluid from the pump outlet to the annulus) and the pump inlet may be coupled to the valve outlet and/or the second pressure chamber, then the operation of the pump may cause and/or vary the pressure differential between the first and second pressure chambers.

The pump may be comprise and/or be operable using a line, conduit or cable, which may extend to the surface in use.

The valve may be configured such that, when in the open configuration, there is a pressure drop across the valve. For example, the valve mechanism may be provided in the flow path and may act to inhibit flow and thereby cause the pressure drop across the valve. This may make it easier for the pump to maintain the required threshold pressure to keep the valve in the open configuration.

A second aspect of the present disclosure is directed to an assembly comprising the pressure actuated downhole device, such as the valve, of the first aspect and a pump or other artificial lift system and/or a packer, such as a seal bore packer.

The pump or other artificial lift system may comprise an electric submersible pump (ESP), a jet pump, a capillary string, a syphon string, a velocity string, or the like. The device (e.g. the pump or other artificial lift system) may be or comprise a cable, line or conduit deployed or operated device.

The valve may be coupled to the pump and/or coupled to the packer. For example, the valve may connect between the packer and the pump. The valve may be configured to be uphole of the packer and/or downhole of the pump, in use.

The seal bore packer may define a through bore. The seal bore packer may comprise a support member, which may be or comprise a tubular member, which may define the through bore. The packer may comprise a sealing element for sealing between the support member and the wall of the wellbore, casing, liner or outward tube. The annulus may be at least partly defined by the packer, valve and/or pump. At least part of the annulus may be provided between an outer surface of at least part of the valve and/or pump and the wall of the wellbore, casing, liner or tubular in which they are provided. The sealing element of the packer may close or configured to selectively close the annulus.

The pump may comprise a hollow pump housing and a pump mechanism. The pump may define a flow path between a pump inlet and a pump outlet. The pump mechanism may be configured to pump fluid along the flow path, e.g. from the pump inlet to the pump outlet. The pump may be configured to generate a pressure differential between the pump inlet and the pump outlet in use, e.g. such that the pump inlet is at a lower pressure than the pump outlet. The pump may be operable to increase the pressure in the annulus and/or in the first pressure chamber of the valve. The pump may be operable to decrease the pressure the valve outlet, in a part of the flow channel through the valve and/or in the second pressure chamber. The pump inlet may be in fluid communication with the valve outlet. The pump inlet may be connected or coupled to the valve outlet.

Pump may comprise at least one connector. The pump housing may define part of the annulus, e.g. the annulus may extend radially from an exterior surface of the pump housing, e.g. between the pump housing and the wall of the wellbore, liner, casing or tubular.

The pump inlet may be configured for fluid connection to the volume within the tubing string, e.g. to the tubing side pressure volume. The pump outlet may be configured for fluid connection to the annulus. The pump may be configured to pump fluid from the volume within the tubing to the annulus.

The pump may be configured so as to create and/or vary the pressure differential between the annulus and the valve outlet and/or the flow channel in the valve. The pump may be configured so as to create and/or vary the pressure differential between the first pressure chamber and the second pressure chamber of the valve.

When the pump is in operation, it may suck fluid through the pump inlet and expel fluid from the pump outlet, which may cause a drop in pressure of the pump inlet with respect to the pump outlet and may cause an increase in pressure at the pump outlet with respect to the pump inlet. As the pump outlet may be in fluid communication with the annulus (e.g. the pump is arranged to expel fluid from the pump outlet to the annulus) and the pump inlet may be coupled to the valve outlet and/or flow path of the valve, then the operation of the pump may cause the pressure differential between the first and second pressure chambers of the valve.

The pump may be, comprise and/or be operable using a line or cable, which may extend to the surface in use.

A third aspect of the present disclosure comprises an assembly including a downhole pump or other artificial lift system and a pressure actuated downhole device, such as a valve, e.g. a safety valve or sub-sea safety valve (SSSV), configured for use downhole. The downhole device may comprise a housing. The downhole device may comprise a flow path between a valve inlet and a valve outlet, which may be at least partially defined by the housing. The downhole device may comprise at least one valve mechanism, which may be located within the housing. The downhole device may comprise at least one piston member, which may be located within the housing. The at least one valve mechanism may be operable by actuation of the at least one piston member, e.g. to selectively open and close the flow path between the valve inlet and valve outlet. The piston member may be configured so as to be actuatable by a pressure or pressure differential, such as a pressure or pressure differential produced by the pump or other artificial lift system, which may be a pressure differential between a pressure external to the valve and a pressure internal to the valve or a pressure at a pump or other artificial lift system inlet and/or valve outlet. The pressure external to the valve may be a pressure in an annulus. The pressure internal to the valve may be a pressure at the valve outlet and/or in a portion of the flow path closest to the valve outlet.

The pressure actuated downhole device may be a downhole device of the first aspect. The assembly may be, comprise or be comprised in the assembly of the second aspect.

A fourth aspect of the present disclosure is directed to a method of operating the assembly of the second aspect and/or the third aspect. The method may comprise providing the valve mechanism in the closed configuration wherein the flow path is closed and wherein the pump or other artificial lift system is inactive or operational below a threshold. The method may comprise controlling the pump or other artificial lift system so that the pump or other artificial lift system is operating or operating above the threshold so as to cause or change pressure or pressure differential, e.g. to reduce a pressure at the valve outlet or increase or create a pressure differential (such as a pressure differential between the annulus and a valve outlet, flow path or second pressure chamber of the valve) to thereby actuate the valve mechanism so as to open the flow path through the valve.

The method may comprise controlling the pump or other artificial lift system so that the pump or other artificial lift system is inactive or operating below the threshold so as to change the pressure or pressure differential, e.g. to reduce or remove the pressure differential (such as the pressure differential between the annulus and a valve outlet, flow path or second pressure chamber of the valve) or to increase the pressure at the valve outlet to thereby actuate the valve mechanism so as to close the flow path.

The individual features and/or combinations of features defined above in accordance with any aspect of the present invention or below in relation to any specific embodiment of the invention may be utilised, either separately and individually, alone or in combination with any other defined feature, in any other aspect or embodiment of the invention.

Furthermore, the present invention is intended to cover apparatus configured to perform any feature described herein in relation to a method and/or a method of using or producing, using or manufacturing any apparatus feature described herein.

BRIEF DESCRIPTION OF THE FIGURES

These and other aspects of the present invention will now be described, by way of example only, with reference to the accompanying drawings, in which.

DETAILED DESCRIPTION OF VARIOUS EMBODIMENTS

Figure 1:
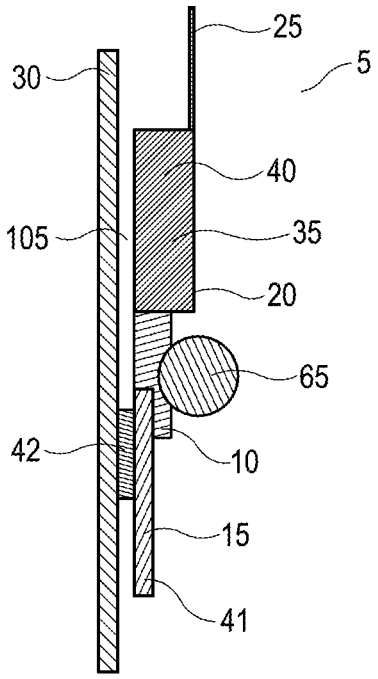
FIG. 1 is a simplified, diagrammatic, longitudinal cross-sectional view of a downhole assembly comprising a pressure operated valve.

FIG. 1 shows an assembly 5 comprising a safety valve 10 disposed between a packer 15 and a pump 20. Although, only half of the assembly 5 is shown, it will be appreciated that another half of components such as the valve 10, packer 15, pump 20 and production tubing 30 will be present. In this example, the pump 20 is provided uphole of the valve 10, which is in turn provided uphole of the packer 15. The pump 20 in this example is a cable deployed electric submersible pump (ESP) that is connected to the surface by a control line 25. However, in other embodiments, other types of pump or artificial lift system could be used, such as a jet pump, a capillary string, a syphon string, a velocity string, or the like. In embodiments, the pump or other artificial lift system comprises a cable, line or conduit deployed or operated device. The assembly is provided downhole inside tubing 30, in this case production tubing that is incorporated in a production string used to produce well fluids.

The pump comprises an electric motor 37 provided downhole of a pump section 40 that is operable by the motor 37. The electric motor 37 is powered and controlled from the surface using the control line 25. Although an electric motor 37 is provided in this example, it will be appreciated that other types of motor could be used, such as a hydraulic pump (e.g. a hydraulic submersible pump (HSP).

The packer 15 is a seal bore packer that comprises a support member 41 that defines a bore therethrough and a sealing member 42 that bears between the production tubing 30 and the support member 41 of the packer 15. The valve 10 and pump 20 are spaced apart from an inner wall of the tubing 30 so as to define part of an annulus 105. The sealing member 42 of the packer 15 seals the annulus. As such, the packer 15 separates fluid communication from downhole (through the bore of the packer 15) and uphole (i.e. from pump outlets of the pump 20). In other words, fluid from downhole of the packer 15 can be sucked up through the bore of the packer 15 by the pump 20 but fluid in the annulus 105 upstream of the packer 15 is prevented from returning downhole by the sealing member 42. The valve 10 can either be run in (and retrieved) with the packer 15 or provided separately. The valve 10, packer 15 and pump 20 can connect together using any suitable coupling method, such as using snap latches and/or the like.

Figure 2:
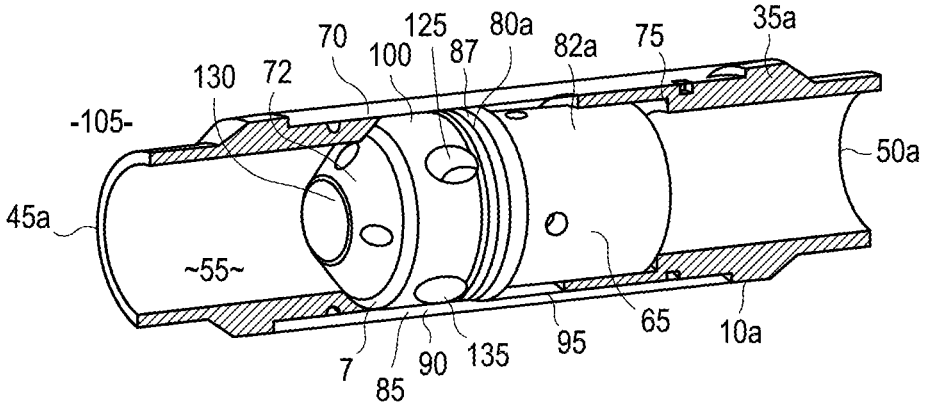
FIG. 2 is a simplified cut-away view of a pressure operated valve.
Figure 3:
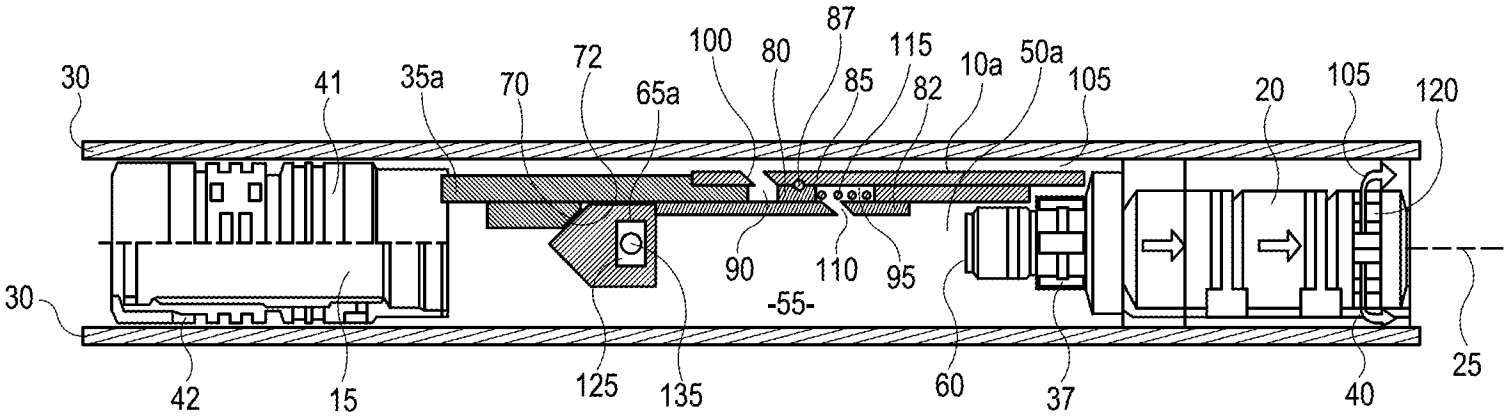
FIG. 3 is a simplified cross section of the valve of FIG. 2 in the downhole assembly of FIG. 1.
Figure 4:
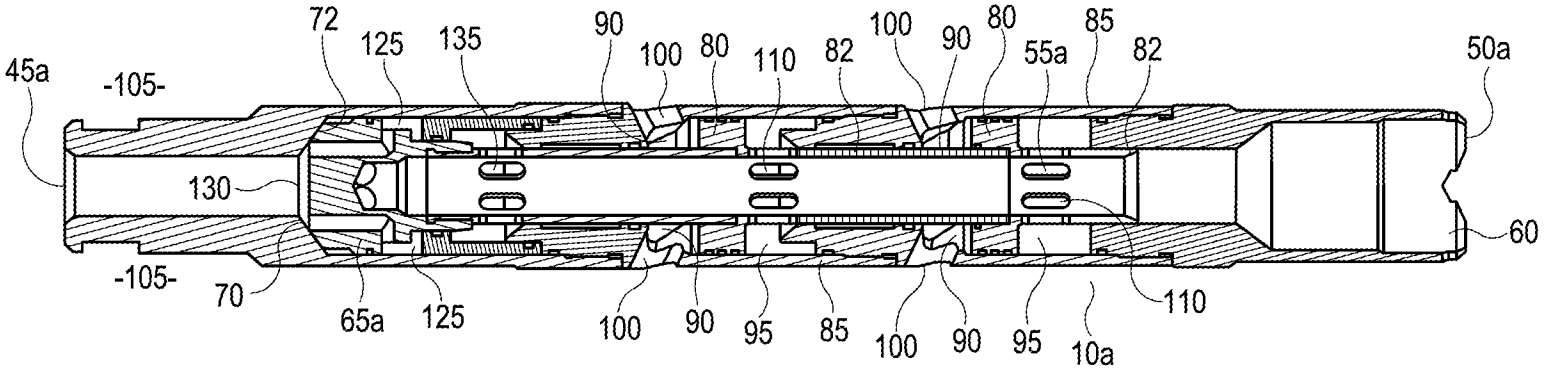
FIG. 4 is a simplified cross section of the valve of FIG. 2.

FIG. 2 shows an example 10*a* of the valve 10 and FIG. 3 shows the valve 10*a* of FIG. 2 assembled into the assembly 5*a*, comprising the packer 15 and pump 20. FIG. 4 shows a more detailed cross section of the valve 10*a* shown in FIGS. 2 and 3. Although FIG. 3 shows only part of the valve mechanism 65*a* and valve housing 35*a* for clarity of illustration, it will be appreciated that these extend around in three dimensions, as shown in FIG. 2, and will comprise corresponding parts in the lower half of the production tubing 30.

The valve 10*a* is beneficially operated by drawdown using the pump 20 without a dedicated control line that can be difficult to deploy and would be difficult to route past the pump 20 to reach the surface. Furthermore, the valve 10*a* is configured so as not to be operated by pressure differential between a valve inlet 45*a* and valve outlet 50*a* (i.e. a differential between uphole and downhole pressures) and is instead only operable between open and closed configurations by pressure differentials generated by the pump 20.

The valve 10*a* comprises a housing 35*a*, the valve inlet 45*a* and the valve outlet 50*a* connected by a valve bore 55*a* that is defined by the housing 35*a* of the valve 10*a*. The valve inlet 45*a* is configured for connection to the packer 15 bore whilst the valve outlet 50*a* is configured for fluid connection to a pump inlet 60 (see FIG. 3). In this way, when the valve 10*a* is in the open configuration, then fluid can pass from the bore in the packer 15, through the valve inlet 45*a*, the valve bore 55*a* and the valve outlet 50*a* to the pump inlet 60. Thereafter, the fluid can be pumped by the pump mechanism out from pump outlets 120 (see FIG. 3) into the annulus 105.

The valve 10*a* comprises a valve mechanism 65*a*, in this case in the form of a poppet, that is slidably located within the valve bore 55*a*. The use of a poppet is beneficial as it copes well with unloading under pressure and may provide a higher flow rate for a given size, but it will be appreciated that other suitable mechanisms could be used. A valve seat 70*a* in the valve bore 55*a* is configured to engage a sealing surface 72*a* of the valve mechanism 65*a* (i.e. the poppet) when the valve 10*a* is in the closed configuration in order to limit the range of motion of the valve mechanism 65*a* and to seal the valve bore 55*a* closed. An end stop 75 is provided to limit the range of motion of the valve mechanism 65*a* when the valve 10*a* is in the open configuration. A biasing member 115 is provided to bias the valve mechanism 65*a* into the closed configuration in which the sealing surface 72 of the valve mechanism 65*a* seals against the valve seat 70 in order to close the valve bore 55.

In this case, the biasing member 115 is in the form of a coiled spring that bears between a piston member 80*a* and a spring seat in the valve housing 35*a* so as to bias the valve mechanism 65*a* towards the valve 10*a* closed configuration. Although a biasing member 65*a* in the form of a coil spring is described, other biasing arrangements could be used to produce the same result.

The valve mechanism 65*a* is provided with the integral piston member 80*a*, in this case in the form of a radially protruding flange. A pump end portion 82*a* of a side wall of the valve mechanism 65*a* that is on an opposite side of the piston member 80*a* to the valve seat 70 is configured to seal against the wall of the valve bore 55. The wall of the valve bore 55*a* comprises a recessed part 85*a* having a diameter that is wider than adjacent portions of the valve bore 55. A radially outer part of the piston member 80*a* is provided with a piston 87 seal that seals against the recessed part 85 of the bore 55. In this way, the outer wall of the valve mechanism 65*a* and the recessed part 85 of the bore 55*a* define a chamber that is separated into a first chamber 90 and a second chamber 95 by the piston member 80*a*. The housing 35*a* is provided with a through channel 100*a* between the first chamber 90 and the annulus 105 located between the radially outer surface of the housing 35*a* of the valve 10*a* and a radially inner surface of the tubing 30. In this way, the first chamber 90 is in fluid communication with, and at the same pressure as, the annulus 105. Rather than taking the specific form shown, the through channel may be implemented using a control line or other conduit or mechanism to ensure that the first chamber 90 follows the pressure in the annulus 105. For example, if the valve is deployed at the bottom of a feedthrough packer, then a control line may extend between the first chamber 90 and a feedthrough of the feedthrough packer in order to sense pressure in the annulus 105.

The pump end portion 82 of the valve mechanism 65*a* that forms the second chamber 95 is provided with a through passage 110 that is in fluid communication with the pump inlet 60 via the portion of the valve bore 55*a* that is closest to the valve outlet 50. In this way, the second chamber 95 is at the same pressure as the pump inlet 60. This arrangement allows the valve 10*a* to be operated responsive to operation of the pump 20.

In particular, when the pump 20 is operational, it will suck fluid in fluid from the valve bore 55*a* via the pump inlet 60 and expel the fluid via pump outlets 120 into the annulus 105. This causes a pressure drop at the pump inlet 60 with respect to the pump outlets 120, which conversely experience an increase in pressure. This in turn creates a pressure differential between the pump inlet 60 (and thereby the valve outlet 50*a*, the portion of the valve bore 55*a* closest to the valve outlet 55*a* and the second chamber 95) and the pump outlet 120 (and thereby the annulus 105 and the first chamber 90).

As such, the piston member 80*a* experiences a pressure differential between the relatively high annulus 105 pressure on one side and the relatively lower valve bore 55*a* pressure and the force applied by the biasing member 115 on the other. When the pressure differential on the piston member 80*a* reaches a certain threshold that depends, amongst other factors, on the force exerted by the biasing member 115, the piston member 80*a* and thereby the valve mechanism 65*a* are moved to compress the biasing member 115 due to the higher pressure in the annulus 105 when the pump 20 is operational. This results in the sealing surface 72 of the valve mechanism 65*a* being moved away from the valve seat 70*a* to thereby open the valve 10*a* and allow fluid flow from the valve inlet 45 through the valve bore 55 to the valve outlet 50/pump inlet 60.

Optionally, even when in the open configuration, the valve mechanism 65*a* acts to inhibit flow (e.g. by being located within the valve bore 55) and thereby cause a certain pressure drop across the valve 10*a*. In this way, it may be easier for the pump 20 to maintain the pressure differential needed to hold the valve mechanism 65*a* open, as the opening of the valve 10 may result in a rise in the pressure in the valve bore 55.

When the pump 20 is switched off or its output or operation is reduced such that the differential pressure drops below the threshold (e.g. due to fluid from the valve inlet 45*a* passing into the valve bore 55*a* whilst the valve 10*a* is still open to equalise the pressure), then the biasing member 115 acts to return the valve mechanism 65*a* into the closed configuration in which the sealing surface 72 of the valve mechanism 65*a* is returned to seal against the valve seat 70 to thereby close the valve 10*a* and prevent fluid flow from the valve inlet 45*a* through the valve bore 55*a* to the valve outlet 50*a*/pump inlet 60.

In this way, the valve 10*a* is reversibly operable between the open and closed configurations by operation of the pump 20 and without a dedicated control line for the valve 10*a* such as an electrical or hydraulic control line that runs between the valve 10*a* and the surface. As such, the valve 10*a* can be conveniently located downhole of the pump 20 without having to make provisions for the running of a control line for the valve 10*a* past the pump 20.

The valve mechanism 65 (e.g. the poppet 65*a*) is provided with a sub-chamber 125 behind an end surface 130 of the valve mechanism 65*a* that is closest to the packer 15 (e.g. the downhole end). The sub-chamber 125 is provided with one or more communication channels 135 so that the sub-chamber 125 receives downstream (e.g. uphole) pressure (e.g. from the first chamber 90). Furthermore, the outer surface of the valve mechanism 65 slopes obliquely radially outwardly as it extends away from the end surface 130 of the valve mechanism 65 that is closest to the packer 15 (e.g. the downhole end). In this way, the surface area of the sub-chamber 125 is larger than the area of the surface at the end 130 of the valve mechanism 65 that is closest to the packer 15. At least part of the sloping section of the valve mechanism 65 optionally forms the sealing surface 72 of the valve mechanism 65.

In this way, the downstream pressure acts on the sloping part of the valve mechanism (e.g. the sealing surface) and acts to keep the valve mechanism 65 (e.g. the poppet 65*a*) closed when the pump is not operational or operating below the threshold, regardless of the pressure differential acting across the valve 10*a* between the valve inlet 45*a* and the valve outlet 50*a*, e.g. at least under normal or rated operating pressures of the valve 10*a*. In this way, the valve 10*a* is operable between the open and closed configurations only by operation of the pump 20 (e.g. by the differential pressure between the annulus 105 and the pump inlet 60/valve outlet 50*a*) and not by the differential pressure between the valve inlet 45*a* and valve outlet 50*a*. In this way, the valve 10*a* may be more surely operable only by the pump 20 and resists or prevents mis-operation between the open and closed configurations due to the differential pressure between the valve inlet 45*a* and the valve outlet 50*a*.

Although a particularly beneficial arrangement is described above, it will be appreciated that other valves that operate on similar principles are possible. For example, although a beneficial valve 10*a* in which the valve mechanism 65 is a poppet 65*a* is described above, other valve mechanisms 65 such as sliding sleeves, flapper valves, ball valves, and/or the like, could be used.

Figure 5:
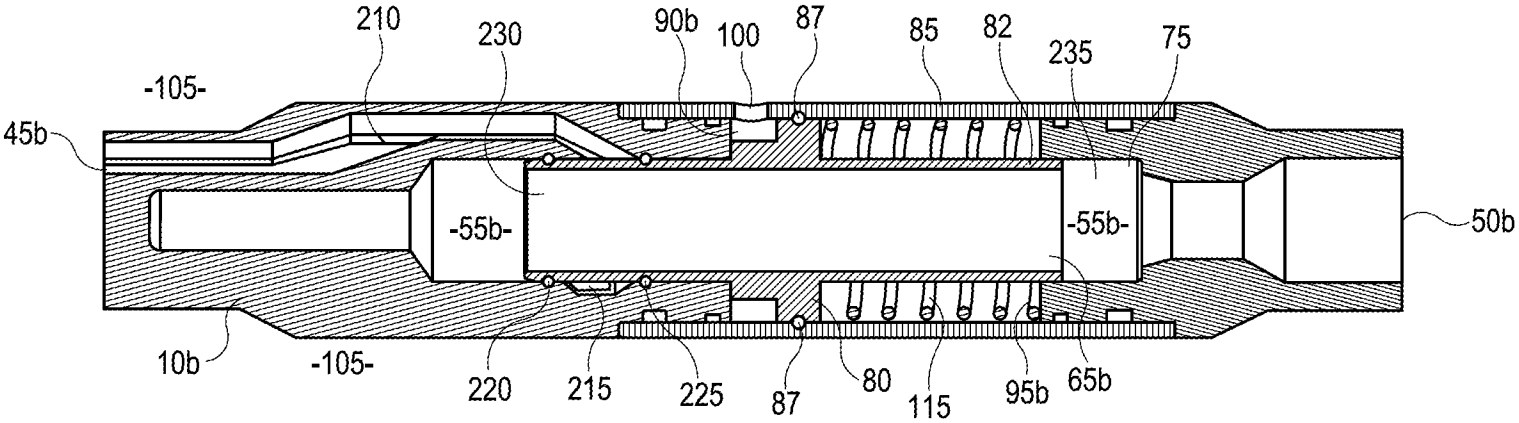
FIG. 5 is a simplified cross-sectional view of an alternative pressure operated valve in a closed configuration.
Figure 6:
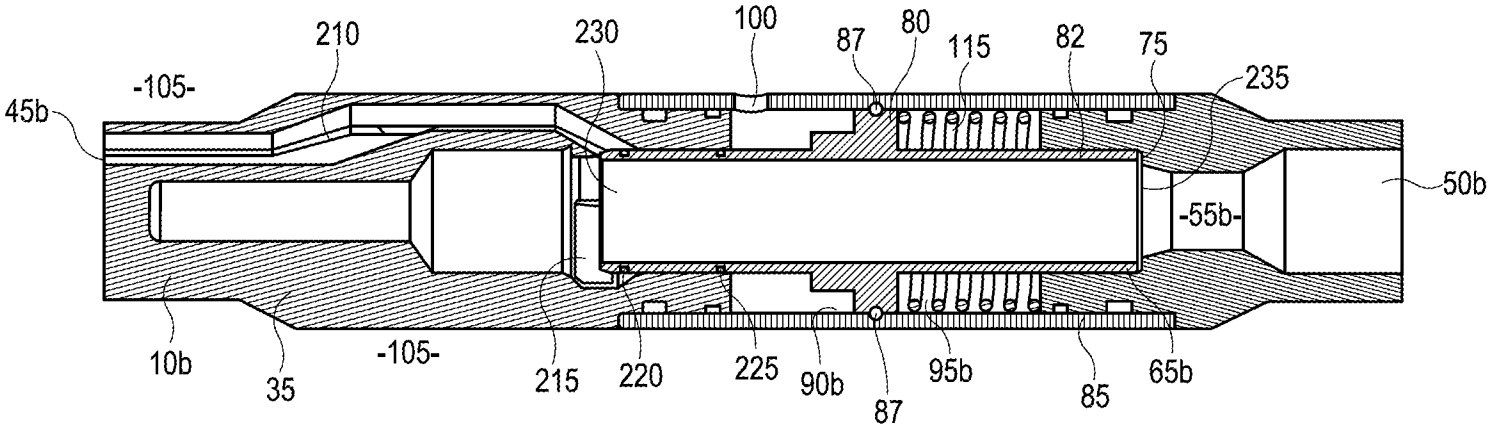
FIG. 6 is a simplified cross-sectional view of the pressure operated valve of FIG. 5 is an open configuration.

An alternative example that is similar to that of FIGS. 2 and 3 but in which the valve mechanism 65 is a sliding sleeve 65*b* is shown in FIGS. 4 to 6. Like reference numerals are used to indicate components of the example of FIGS. 4 to 6 that perform a similar function to those shown in FIGS. 2 and 3 but suffixed with 'b' rather than 'a'.

FIGS. 5 and 6 show a cross sectional view of an alternative valve 10*b*. FIG. 5 shows a detailed cross section of the valve 10*b* in a closed configuration, whilst FIG. 6 shows the valve 10*b* in an open configuration.

The valve 10*b* comprises a housing 35*b* that houses a valve mechanism 65 in the form of a sliding sleeve 65*b* that is slidably mounted in the valve bore 55*b*. In this example, the sliding sleeve 65*b* comprises a hollow elongate generally cylindrical tubular member with a longitudinally extending bore 200 therethrough. The sliding sleeve 65*b* comprises one or more piston members 80*b* in the form of a flange that comprises a piston seal 87 on a radially outer surface thereof. The flange forming the piston member 80*b* extends radially outwardly from the sliding sleeve 65*b* such that the piston seal 87 engages and seals against an inner wall of a recessed part 85*b* of the valve bore 55*b*. The piston seal 87 in this example is in the form of an O-ring but it will be appreciated that other seal types could be used. In this way, the recessed portion 85*b* is divided into a first chamber 90*b* and a second chamber 95*b* by the piston member 80*b*, the relative volumes of which are variable by sliding movement of the piston member 80*b*. Similarly to the embodiment of FIGS. 2 and 3, the valve mechanism 65*b* is biased towards and/or into the closed configuration by a biasing member 115*b* such as a spring. Optionally, more than one piston member 80*b*, recessed parts 85*b* and corresponding first and second chambers 90*b*, 95*b* could be provided if more force is required to move the valve mechanism 65*b*.

As in the example of FIGS. 2 and 3, the portion of the housing 35*b* that forms the wall of the first chamber 90*b* comprises an opening 100*b* that extends form the first chamber 90*b* and is open on an outer surface of the valve

10*b*. In this way, the first chamber 90*b* is in fluid communication with the annulus 105 via the opening 100*b*. The second chamber 95*b* is in fluid communication with the pump inlet 60 via a portion of the valve bore 55*b* and the valve outlet 50*b*.

In this way, the valve mechanism 65 in the form of the sliding sleeve 65*b* is selectively and reversibly movable back and forth between the closed configuration shown in FIG. 5 and the open configuration shown in FIG. 6 by operation of the pump 20 to vary the pressure differential between the annulus 105 and the valve outlet 50/pump inlet 60.

Operation of the pump 20 acts to pump fluid from the valve bore 55*b* through the pump inlet 60 and out from the pump outlets 120 into the annulus 105. This creates a pressure differential between the annulus 105 (and thereby the first chamber 90*b*) and the pump inlet 60 (and thereby the valve outlet 50*b*, at least part of the valve bore 55*b* and the second chamber 95*b*), with the annulus 105 being at a higher pressure than the pump inlet 60. If the pressure differential exceeds a certain threshold (determined in part by the biasing member 115 and friction) then the piston member 80*b* and thereby the valve mechanism 65 (i.e. the sliding sleeve 65*b*) is driven from the closed configuration shown in FIG. 5 to the open configuration shown in FIG. 6. If the pressure differential reduces below the threshold, then the valve mechanism 65 (i.e. the sliding sleeve 65*b*) is returned from the open configuration shown in FIG. 6 to the closed configuration shown in FIG. 5 under the action of the biasing member 115. In this way, the valve 10*b* is reversibly and selectively operable between the open and closed configurations by the pump 20.

In the example of FIGS. 5 and 6, a feed passage 210 extends from the valve inlet 45*b* to an opening 215 proximate an end of the valve mechanism 65 (i.e. the sliding sleeve 65*b*) that is furthest from the pump 20, in use. The opening 215 opens out part way along an inner side wall of the valve bore 55*b*, towards the end of the valve bore 55*b* that is furthest from the pump 20, in use. The opening 215 and/or a portion of the feed passage 210 closest to the opening 215 is arranged such that it faces perpendicularly or at least obliquely (e.g. 45° or more) to a direction in which the valve mechanism 65*b* moves.

The valve mechanism 65, i.e. the sliding sleeve 65*b*, is arranged such that, in the closed configuration shown in FIG. 6, a side wall of the sliding sleeve 65*b* closes and seals the opening 215. In particular, the sliding sleeve 65*b* comprises a pair of inlet seals 220, 225 that seal between a radially outer surface of the side wall of the sliding sleeve 65*b* and the inner side wall of the valve bore 55*b*. In this example the inlet seals 220, 225 comprise O-rings but other types of seals could be used.

In the open configuration shown in FIG. 6, the inlet seals 220, 225 and an open end 230 of the sliding sleeve 65*b* that is at an opposite end of the sliding sleeve 65*b* to the pump 20, in use, are located on a pump side of the opening 215. In this way, the opening 215 is in fluid communication with the valve bore 55 and the open end 230 of the sliding sleeve 65*b* such that fluid from the valve inlet 45*b* can flow through the feed passage 210, out through the opening 215 into the valve bore 55 and down through the bore 200 that runs longitudinally through the sliding sleeve 65*b* to the valve outlet 50*b* and thereby the pump inlet 60.

In the closed configuration shown in FIG. 5, one of the inlet seals 220 and the open end 230 of the sliding sleeve 65*b* that is at an opposite end of the sliding sleeve 65*b* to the pump 20, in use, are located on a side of the opening 215 that is away from the pump 20, in use, and the other of the inlet seals 225 is located on the opposite side of the opening 215 (i.e. the side of the opening 215 that is toward the pump 20, in use). As such, one of the pair of inlet seals 220 is located on one side of the opening 215 and the other of the inlet seals 225 is located on the other side of the opening, with the outer side wall of the sliding sleeve 65*b* spanning the two inlet seals 225, to thereby seal closed the opening 215 and to isolate the open end 230 of the sliding sleeve 65*b* from the opening 215.

As the part of the feed passage 210 closest to the opening 215 extends perpendicularly to the direction of movement of the sliding sleeve 65*b* and faces a radially outer side wall of the sliding sleeve rather than one of the ends 230, 235 of the sliding sleeve, when the valve 10*b* is in the closed configuration shown in FIG. 5, the valve 10*b* stays closed regardless of the pressure differential between the valve inlet 45*b* and the valve outlet 50*b*. The biasing member 115 also assists with keeping the valve in the closed configuration. Thus, the valve 10*b* is more surely operable only by operation of the pump 20 and/or the pressure differential between the annulus 105 and the part of the valve bore 55*b* that is in fluid communication with the pump inlet 60, and is not or less subject to mis-operation due to variations in differential pressure between the valve inlet 45*b* and valve outlet 50*b*.

Although various examples of types of valve mechanisms 65 and methods for ensuring that the valve 10, 10*a*, 10*b*/valve mechanism 65, 65*a*, 65*b* is operable by the pump 20 and/or differential pressure between the annulus 105 and part of the valve bore 55 and is not operable by pressure differential between the valve inlet 45 and valve outlet 50 are described above, the present disclosure is not limited to these, and other possibilities could be used and/or would be apparent to a skilled person from the present disclosure.

Figure 7:
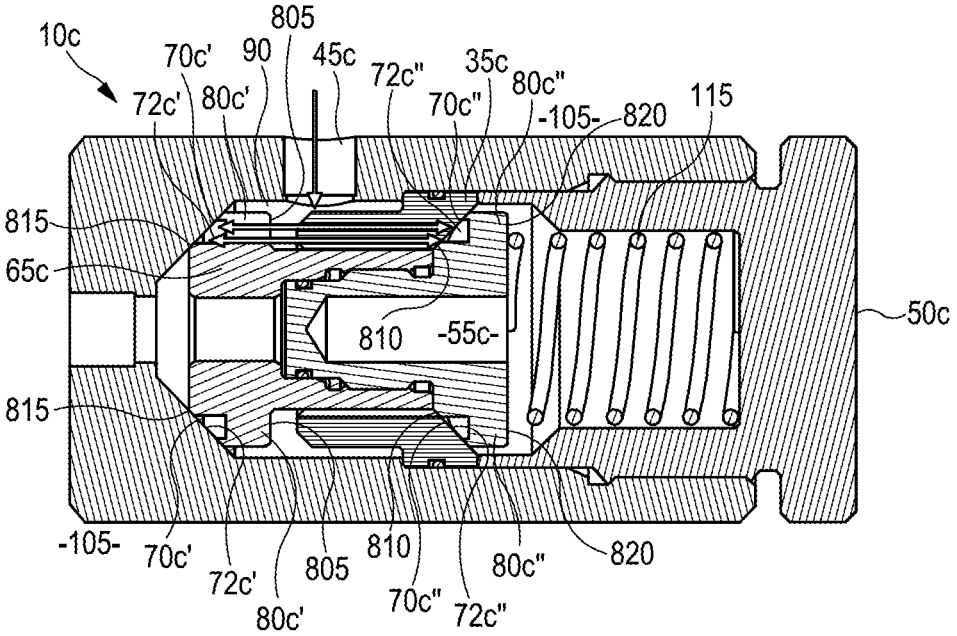
FIG. 7 is a simplified cross-sectional view of an alternative pressure operated valve in a closed configuration.
Figure 8:
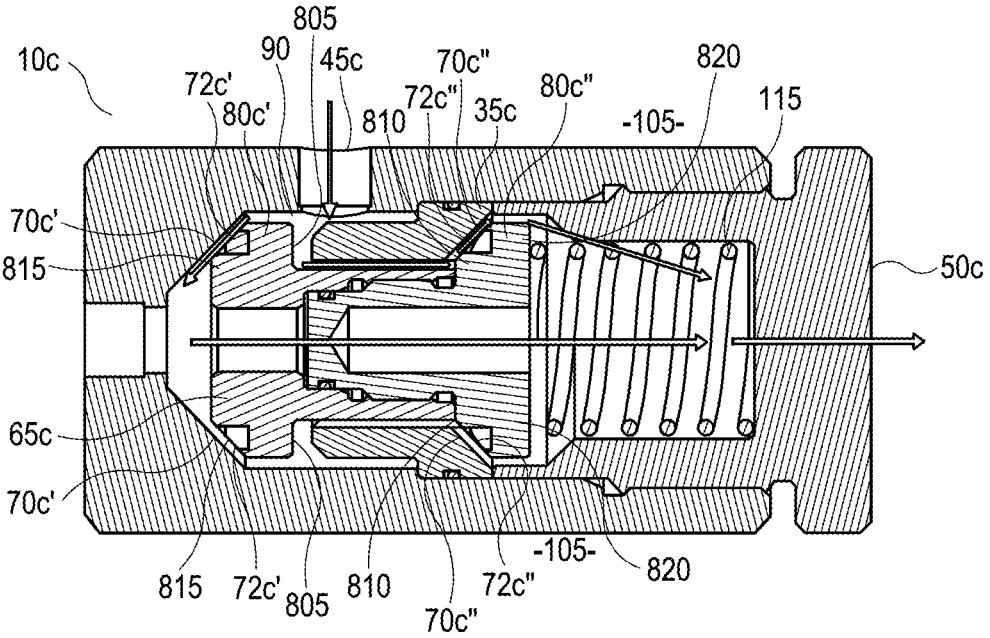
FIG. 8 is a simplified cross-sectional view of an alternative pressure operated valve in an open configuration.

FIGS. 7 and 8 show a cross sectional view of another alternative valve 10*c*. FIG. 7 shows a detailed cross section of the valve 10*c* in a closed configuration, whilst FIG. 8 shows the valve 10*c* in an open configuration.

The valve 10*c* comprises a valve housing 35*c* that defines a valve bore 55*c* that extends through the valve housing 35*c* between a valve inlet 45*c* and a valve outlet 50*c* (wherein the valve outlet 50*c* is configured to be in fluid communication with a pump inlet 60 of the pump 20 in use). Although the pump 20 is not shown, it could be arranged in a corresponding manner to that shown in FIG. 1 or 3. The valve 10*c* further comprises a valve mechanism 65*c*, in this case in the form of a double poppet, that is slidably located within the valve bore 55*c* provided in a valve housing 35*c*. The valve mechanism 65*c* comprises two sealing surfaces, namely first and second sealing surfaces 72*c*' and 72*c*", and two corresponding valve seats, namely first and second valve seats 70*c*' and 70*c*".

The valve mechanism 65*c* is selectively actuatable between the open configuration shown in FIG. 8 in which fluid may pass from the valve inlet 45*c* to the valve outlet 50*c* and the closed configuration shown in FIG. 7 in which fluid flow from the valve inlet 45*c* to the valve outlet 50*c* is prevented. In particular, the valve mechanism is actuatable between the open and closed configurations responsive to the pressure at the valve outlet 50*c*, which depends on the operation of the pump 20 that is in fluid communication with the valve outlet 50*c* in use, and irrespective of the pressure applied to the valve inlet 45*c*, i.e. the actuation of the valve mechanism 65*c* is unaffected by the fluid pressure at the valve inlet 45*c*.

The valve mechanism 65*c* is configured such that, when the valve mechanism 65*c* is in the closed configuration, the first and second valve seats 70*c*' and 70*c*" respectively engage the first and second sealing surfaces 72*c*' and 72*c*" so as to seal the valve bore 55*c* closed. The valve mechanism 65*c* is configured such that, when the valve mechanism 65*c* is in the open configuration, the first and valve seats 70*c*' and 70*c*" are spaced apart from the first and second sealing surfaces 72*c*' and 72*c*" respectively so as to open the valve bore 55*c*.

A biasing member 115 is provided to bias the valve mechanism 65*c* toward the closed configuration. In this case, the biasing member 115 is in the form of a coiled spring that bears between the valve mechanism 65*c* and a fixed spring seat (not shown) in the valve housing 35*c* so as to provide a basing force that biases the valve mechanism 65*c* towards the valve 10*c* closed configuration. Although a biasing member 65*a* in the form of a coil spring is described, other biasing arrangements could be used to produce the same result. When the pump is not being operated, then the valve mechanism 65*c* is biased into the closed configuration, i.e. the valve 10*c* defaults to the closed configuration. However, it will be appreciated that in other embodiments, the reverse could be configured, i.e. the valve defaults to open.

The valve mechanism 65*c* is provided with two piston members, namely first and second piston members 80*c*', 80*c*", in this case in the form of radially protruding flanges. The first and second piston members 80*c*', 80*c*" and the first and second sealing surfaces 72*c*' and 72*c*" are all coupled together or integral so that they are slidable together in tandem. Both the first and second piston members 80*c*', 80*c*" are in fluid communication with a chamber 90*c* formed in the valve housing 35*c*, the chamber 90*c* being in fluid communication with the valve inlet 45*c*.

Both the first piston member 80*c*' and the second piston member 80*c*" are provided between the first chamber 90*c* and a portion of the valve bore 55*c* that is in fluid communication with the valve outlet 50*c*. The first piston member 80*c*' comprises a face 805 that faces into the chamber 90*c* and a face 815 that faces towards the valve bore 55*c*. The second piston member 80*c*" comprises a face 810 that faces into the chamber 90*c* and a face 820 that faces towards the valve bore 55*c*.

The first and second piston members 80*c*', 80*c*" are configured to oppose each other. In this example, the first piston member 80*c*' is configured such that positive fluid pressure in the chamber 90*c* acts on the face 805 of the first piston member 80*c*' that pushes the first sealing surface 72*c*' onto the first valve seat 70*c*' and pushes the second sealing surface 72*c*" onto the second valve seat. In contrast, the second piston member 80*c*' is configured such that positive fluid pressure in the chamber 90*c* acts on the face 810 of the second piston member 80*c*" that pushes the first sealing surface 72*c*' away from the first valve seat 70*c*' and the second sealing surface 72*c*" away from the second valve seat 70*c*".

Properties of the first and second piston members 80*c*', 80*c*", such as the piston diameter, piston surface area, seal friction and the like, can be selected so that the fluid in the chamber 90*c* applies a substantially equal force on both the face 805 of the first piston member 80*c*' and the face 810 of the second piston member 80*c*" (or at least such that any difference in force is always less than the biasing force applied by the biasing member for at least the operational pressure range of the valve 10*c*). For example, the contact area between the first sealing surface 72*c*' and the first valve seat 70*c*' may be at the same diameter as, or radially overlap, the contact point between the second sealing surface 72*c*" and the second valve seat 70*c*". In this way, the piston diameter or area of the first piston member 80*c*' and the second piston member 80*c*" that faces into the chamber 90*c* when the valve mechanism 65*c* is in the closed configuration may be substantially the same. In this way, the valve 10*c* cannot be actuated between the open and closed configurations by simply changing the pressure at the valve inlet 45*c* alone, as this would simply apply opposing similar or equal forces on each of the first and second piston members 80*c*', 80*c*" such that there is no net effect, or at least insufficient net effect to overcome the biasing force applied by the biasing member 115. Instead the valve mechanism 65*c* is actuatable between the open and closed configurations responsive to operation of the pump 20 to change the pressure at the valve outlet 50*c* regardless or irrespective of the pressure at the valve inlet 45*c*.

The closed configuration is shown in FIG. 7, in which the combination of the positive pressure differential between the valve inlet 45*c*/pressure chamber 90*c* and the valve outlet 50*c*/pump inlet 60 acting on the face 805 of the first piston member 80*c*' and the biasing force applied by the biasing member 115 overcomes the effects of the pressure differential between the valve inlet 45*c*/pressure chamber 90*c* and the valve outlet 50*c*/pump inlet 60 acting on the opening face 810 of the second piston member 80*c*', such that the first sealing surface 72*c*' is forced into sealing engagement with the first valve seat 70*c*' and the second sealing surface 72*c*" is forced into sealing engagement with the second valve seat 70*c*" so as to seal the valve bore 55*c* closed.

However, the piston diameter or surface area of the first piston member 80*c*' that faces into the valve bore 55*c* may be smaller than the piston diameter or surface area of the second piston member 80*c*" that faces into the valve bore 55*c*. For example, a diameter and/or surface area of the face 815 of the first piston member 80*c*' on the valve bore 55*c* side of the contact point between the first sealing surface 72*c*' and the first valve seat 70*c*' when the valve 10*c* is in the closed configuration may be less than a diameter and/or surface area of the face 820 of the second piston member 80*c*" that faces into the valve bore 55*c* from the contact point between the second sealing surface 72*c*" and the second valve seat 70*c*". This may be achieved, for example, by having the first and second sealing surfaces 72*c*', 72*c*" on sloping faces 815, 810 of the first and second piston members 80*c*', 80*c*", wherein the face 815 of the first piston member 80*c*' reduces in diameter from the valve inlet 45*c* side to the valve bore 55*c* side whereas the face 810 of the second piston member 80*c*" increases in diameter form the valve inlet 45*c* side to the valve bore 55*c* side. As a result, changing the pressure at the valve outlet 50*c* and thereby in the valve bore 55*c* will have a different effect on the first piston member 80*c*' than on the second piston member 80*c*". Consequently, respectively decreasing and increasing pressure at the valve outlet 50*c* and thereby in the valve bore 55*c* can be used to respectively actuate the valve mechanism 65*c* into the open and closed configurations. In contrast, varying the pressure at the valve inlet 45*c* provides substantially comparable effects on the first and second piston members 80*c*', 80*c*", such that the valve mechanism 65*c* is not actuated by changes in the valve inlet 45*c* pressure alone, irrespective of the magnitude of the valve inlet pressure 45*c*.

Figure 9:
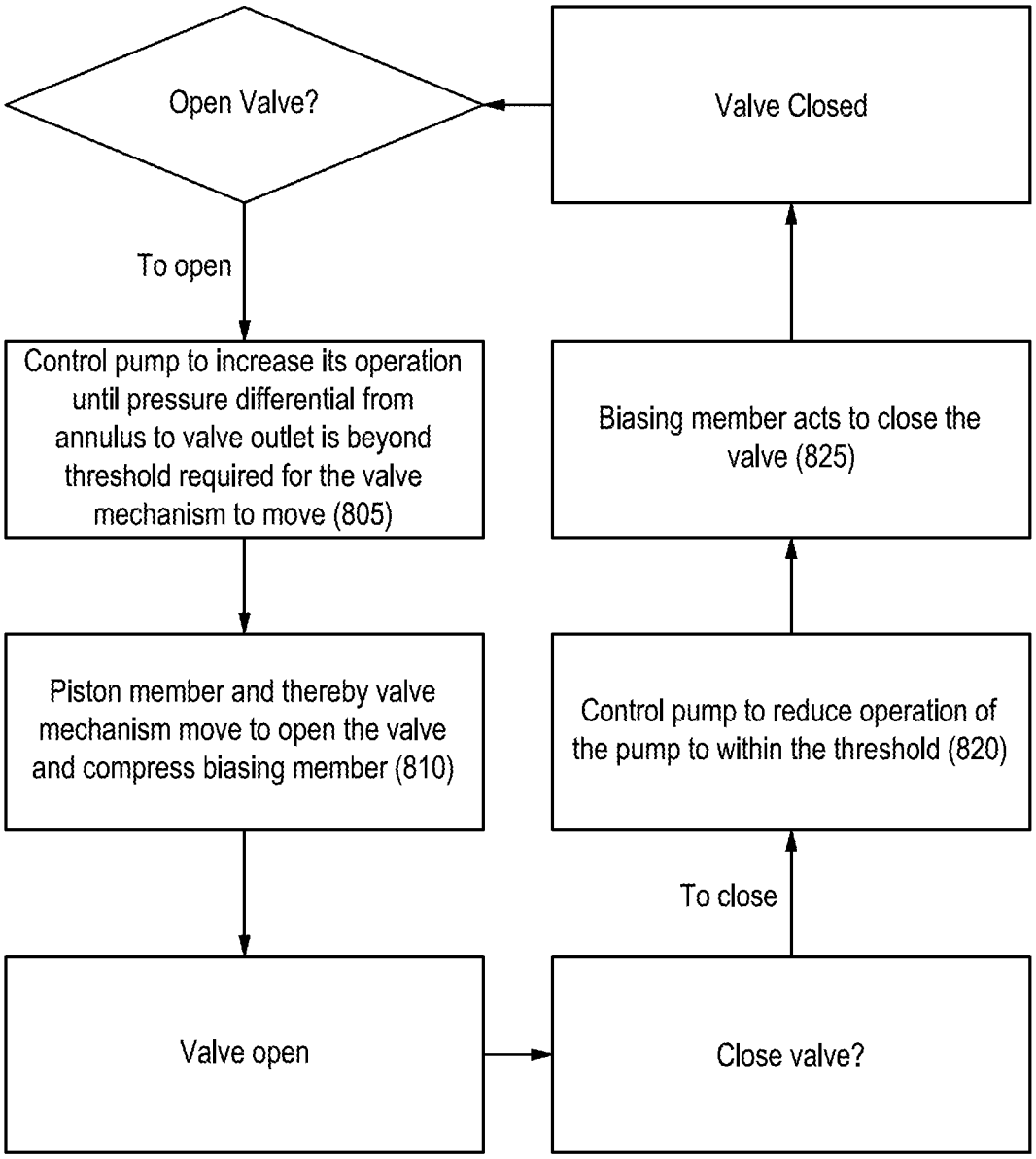
FIG. 9 is a flowchart illustrating a method of operation of a pressure operated valve, such as those of any of FIGS. 2 to 8.
Figure 10:
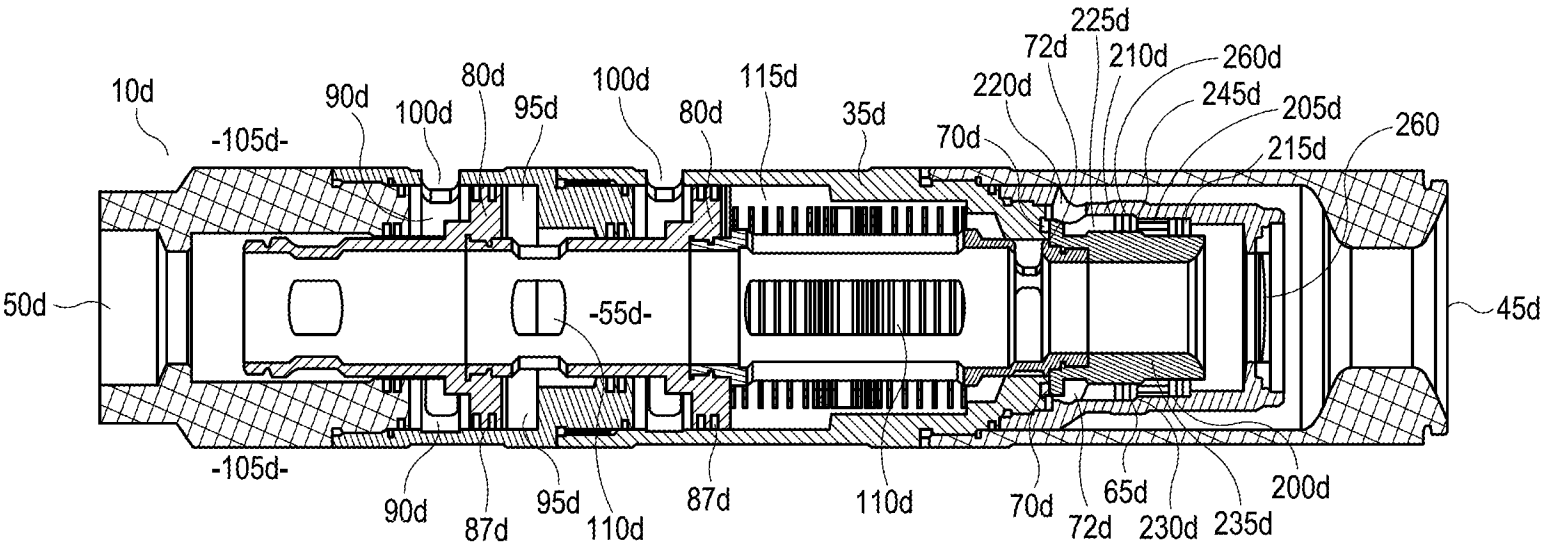
FIG. 10 is a cross sectional view of an alternative pressure operated valve in a closed configuration.
Figure 11:
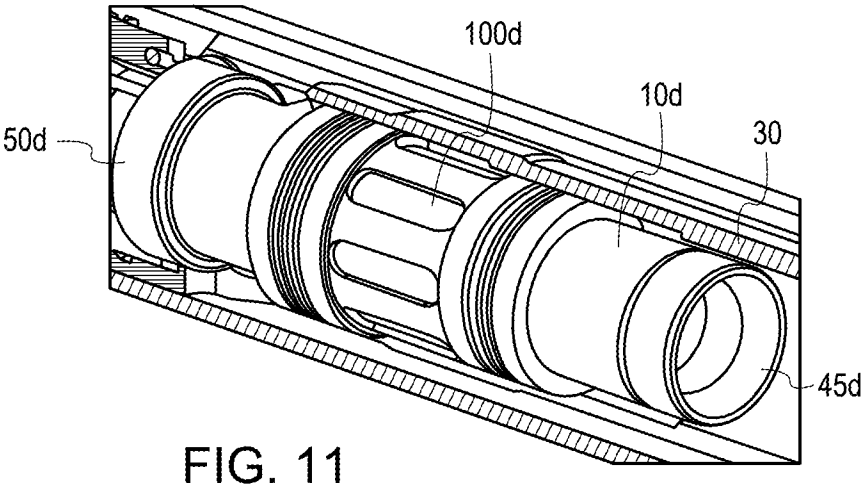
FIG. 11 is a perspective view of the pressure operated valve of FIG. 10.

When the pump is operated to pump fluid from the valve outlet 50*c* and thereby from the valve bore 55*c*, the drop in pressure in the valve bore 55*c* acting on the different sized faces 815, 810 of the first and second piston members 80*c*', 80*c*" results in a force on the first and second piston members 80*c*', 80*c*" that, once is it sufficient to overcome the biasing force applied by the biasing member 115, causes the valve mechanism 65*c* to actuate into the open configuration in which the first and second sealing surfaces 72*c*', 72*c*" move away from their respective valve seats 70*c*', 70*c*", to thereby open the valve bore 55*c* to through flow from the valve inlet 45*c* to the valve outlet 50*c*. Conversely, when the pump 20 operation is reduced to below a certain level or stopped when the valve mechanism 65*c* is in the open configuration, such that the negative pressure in the valve bore 55*c* acting differently on the first and second piston members 80*c*', 80*c*" is not sufficient to overcome the biasing force applied by the biasing member 115, then the valve mechanism 65*c* is actuated back into the closed configuration. A method of operating a pump drawdown activated valve, such as any of the valves 10, 10*a*, 10*b* shown in any of FIGS. 2 to 8, is illustrated with respect to FIG. 9.

If the valve 10 is closed and the operator wishes to open it, then in step 805, the pump 20 is started or controlled to increase its operation until the pressure differential from the annulus 105 to the valve outlet 50 that is in fluid communication with the pump inlet 60 is greater than a predetermined threshold required for the valve mechanism to move (which may be governed by the biasing member 115, friction between the valve mechanism 65 and the walls of the valve bore 55, and/or the like). In step 810 the differential pressure from the annulus 105/first chamber 90 to the second chamber 95/valve bore 55/pump inlet 60 acts on the piston member 80 so as to move the piston member 80 and thereby the valve mechanism 65 to open the valve 10 and compress the biasing member 115.

In the embodiment of FIGS. 2 to 4, this involves the sealing surface 72 of the valve mechanism 65*a* being moved away from the valve seat 70*a* so as to open the valve bore 55*a* and valve outlet 50*a* to the valve inlet 45*a*, thereby creating an open fluid flow path from the valve inlet 45*a*, through the valve bore 55*a* to the valve outlet 50*a* and pump inlet 60. In the embodiment of FIGS. 5 and 6, this involves the sliding sleeve 65*b* being moved towards the valve outlet 45*b*/pump 20 end of the valve 10*b* so as to move the open end 230 and thereby the bore 200 of the sliding sleeve 65*b* to be in fluid communication with the opening 215, feed passage 210 and valve inlet 45*b*, thereby creating a fluid communication path from the valve inlet 45*b* through the sliding sleeve 65*b* to the valve outlet 50*b* and pump inlet 60.

If the valve 10 is open and the operator wishes to close it, then in step 815, the pump 20 is switched off or controlled to reduce operation of the pump to at least below the threshold. As the differential pressure between the annulus 105 and the valve bore 55 and pump inlet 60 equalises and drops, the force applied to the piston 80 by the differential pressure between the first chamber 90 (which is equal to or at least depends on the annulus 105 pressure) and the second chamber 95 (which is equal to or at least dependent on the pressure in the valve bore 55 and/or pump inlet 60) also drops until it is less than the closing force applied by the biasing member 115 (accounting for friction and any other effects). In this case, the biasing member 115 acts to close the valve, in step 820.

In the embodiment of FIGS. 2 to 4, this involves the sealing surface 72 of the valve mechanism 65*a* being moved towards and into sealing engagement with the valve seat 70*a* by the biasing member 115 so as to close the valve bore 55*a*, thereby closing the path from the valve inlet 45*a*, through the valve bore 55*a* to the valve outlet 50*a* and pump inlet 60. In the embodiment of FIGS. 5 to 6, this involves the sliding sleeve 65*b* being moved away from the valve outlet 45*b*/pump 20 end of the valve 10*b* so as to seal the open end 230 and thereby the bore 200 of the sliding sleeve 65*b* from the opening 215, feed passage 210 and valve inlet 45*b* using the inlet seal 220, thereby preventing fluid communication from the valve inlet 45*b* to the valve outlet 50*b* and pump inlet 60.

In this way, the valve 10 is selectively and reversibly movable between open and closed configurations using the pump 20, regardless of a pressure differential between the valve inlet 45 and a valve outlet 50.

Although various exemplary features are described above, it will be appreciated that variations would be apparent to a skilled person from the teaching of the present application. As such, the scope of protection is defined by the claims and not by any of the specific examples given above, which are provided for illustration only.

An example of another alternative valve 10*d* is shown in FIGS. 10 to 19. The valve 10*d* is similar to that shown in FIGS. 2 to 4 and is operated according to a pressure differential between a valve outlet 50*d* that connects to a pump inlet (not shown) and an annulus around the outside of the valve 10*d* such that it is operable based on pressure differentials generated by the pump 20 (see FIG. 1). Like the valve 10*a*, the valve 10*d* also comprises a housing 35*d*, a valve inlet 45*d* and the valve outlet 50*d* connected by a valve bore 55*d* that is defined by the housing 35*d* of the valve 10*d*. The valve inlet 45*d* is configured for connection to the packer 15 bore (see FIG. 1) whilst the valve outlet 50*d* is configured for fluid connection to a pump inlet. In this way, when the valve 10*d* is in the open configuration, then fluid can pass from the bore in the packer 15, through the valve inlet 45*d*, the valve bore 55*d* and the valve outlet 50*d* to the pump 20. Thereafter, the fluid can be pumped by the pump 20 out from pump outlets into the annulus.

The valve 10*d* comprises a valve mechanism 65*d*, in this case in the form of a poppet, that is slidably located within the valve bore 55*d*. A valve seat 70*d* in the valve bore 55*d* is configured to engage a sealing surface 72*d* of the valve mechanism 65*d* (i.e. the poppet) when the valve 10*d* is in the closed configuration in order to limit the range of motion of the valve mechanism 65*d* and to seal the valve bore 55*d* closed. In this example, the valve mechanism 65*d* is a knife-edge valve in which the sealing surface 72*d* is a sharp, radiussed, arcuate or chamfered edge and the valve seat 70*d* is configured to receive the edge. For example, the valve seat 70*d* may be formed from a relatively soft material, which may be a polymeric material, such as PEEK or a ceramic filled PTFE, or the like. However, the valve seat 70*a* is not limited to polymeric material and could be, for example, a metal seat such as for a metal-to-metal seal or a ceramic seat, or the like. A biasing member 115*d* is provided to bias the valve mechanism 65*d* into the closed configuration in which the sealing surface 72*d* of the valve mechanism 65*d* seals against the valve seat 70*d* in order to close the valve bore 55*d*.

The valve mechanism 65*d* is provided with a plurality of integral piston members 80*d*, in this case in the form of radially protruding flanges. Alternatively, one piston member 80*d* could be used. A radially outer part of the piston members 80*d* is provided with a piston seal 87*d* that seals against an inner wall of the valve bore 55*d*. In this way, the outer wall of the valve mechanism 65*d* and the inner wall of the bore 55*d* define a chamber that is separated into a first chamber 90*d* and a second chamber 95*d* by the piston member 80*d*. The housing 35*d* is provided with suitably located through channels 100*d* between the first chamber 90*d* and the annulus 105*d* located radially outwardly of the housing 35*d* of the valve 10*d*. In this way, the first chamber 90*d* is in fluid communication with, and at the same pressure as, the annulus 105*d*. Again, rather than taking the specific form shown, the through channels 100*d* may be implemented using a control line or other conduit or mechanism to ensure that the first chamber 90*d* senses pressure in the annulus 105*d*. For example, if the valve is deployed at the bottom of a feedthrough packer, then a control line may extend between the first chambers 90*d* and a feedthrough of the feedthrough packer in order to sense pressure in the annulus 105*d*.

The second chamber 95*d* is provided with a through passage 110*d* that is in fluid communication with the pump inlet via the portion of the valve bore 55*d* that is closest to the valve outlet 50*d*. In this way, the second chamber 95*d* is at the same pressure as the pump inlet. This arrangement allows the valve 10*d* to be operated responsive to operation of the pump 20. In particular, when the pump 20 is operational, it will suck in fluid from the valve bore 55*d* via the pump inlet and expel the fluid via pump outlets into the annulus 105*d*. This causes a pressure drop at the pump inlet with respect to the pump outlets, which conversely experience an increase in pressure. This in turn creates a pressure differential between the pump inlet 60*d* (and thereby the valve outlet 50*d*, the portion of the valve bore 55*d* closest to the valve outlet 55*d* and the second chamber 95*d*) and the pump outlet (and thereby the annulus 105*d* and the first chamber 90*d*). As such, the piston member 80*d* experiences a pressure differential between the relatively high annulus 105*d* pressure on one side and the relatively lower valve bore 55*d* pressure and the force applied by the biasing member 115*d* on the other. When the pressure differential on the piston member 80*a* reaches a certain threshold, the piston member 80*d* and thereby the valve mechanism 65*d* are moved to compress the biasing member 115*d*. The sealing surface 72*d* of the valve mechanism 65*d* is also moved away from the valve seat 70*d* to thereby open the valve 10*d* and allow fluid flow from the valve inlet 45*d* through the valve bore 55*d* to the valve outlet 50*d*.

In this regard, the valve 10*d* operates in substantially the same way as the valve 10*a* shown in FIGS. 2 to 4. However, the valve 10*d* differs from that of FIGS. 2 to 4 in that it comprises a further operating mechanism 200*d* that allows bi-directional operation of the valve 10*d*, which may be particularly beneficial for testing.

The further operating mechanism comprises a shuttle sleeve 205*d* that supports a pair of unidirectional seals 210*d*, 215*d*, one at each end of the shuttle sleeve 205*d*. The unidirectional seals comprise a main seal 210*d* and a test seal 215*d*. Both seals 210*d*, 215*d* seal between the outer surface of the valve mechanism (poppet) 65*d* and an inner wall of the valve housing 35*d*. The main seal 210*d* receives fluid, and is exposed to pressure, from downhole via the valve inlet 45*d* and a passage 220*d* through the housing 35*d*. The unidirectional main seal 210*d* is arranged to restrict the well pressure from downhole. The test seal 215*d* is open to the valve bore 55*d* and thereby the valve outlet 50*d* so as to receive fluid, and be exposed to pressure, provided from uphole, particularly from the surface, e.g. through the pump 20 or via a separate pressure line. The unidirectional test seal 215*d* is arranged to resist the pressure from above, e.g. a test pressure provided from the surface.

The shuttle sleeve 205*d* is provided with a first loading shoulder 230*d* arranged to selectively engage a first loading surface 235*d* on an inner wall of the housing 35*d* to limit the range of motion of the shuttle sleeve 205*d* in one direction. The shuttle sleeve 205*d* is also provided with a second loading shoulder 240*d* arranged to selectively engage a second loading surface 245*d* on an outer surface of the valve mechanism (poppet) 65*d* to limit the range of motion of the shuttle sleeve 205*d* in an opposite direction. A biasing member 225*d* biases the shuttle sleeve 205*d* towards the uphole pressure side such that the first loading shoulder 230*d* of the shuttle sleeve 205*d* normally engages the first loading surface of the housing 35*d* unless forced otherwise.

Figure 18:
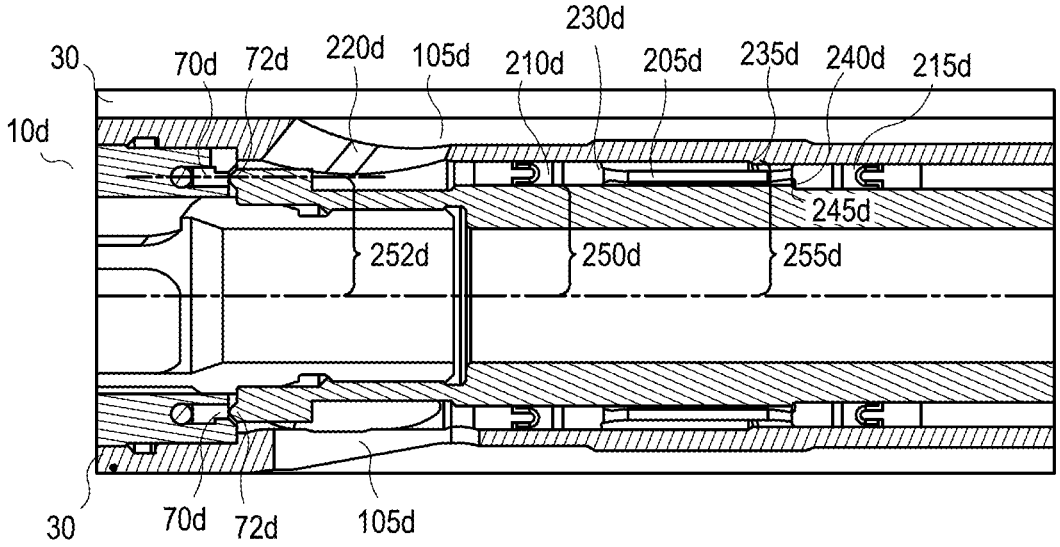
FIG. 18 is a detailed cross sectional view of the pressure operated valve of FIG. 10 in a test configuration.

As shown particularly in FIG. 18, a seal diameter 252*d* of the valve mechanism (poppet) 65*d*, an effective diameter 250*d* of the main seal 210*d* and an effective diameter 255*d* of the test seal 215*d* are in a particular relationship in which the effective diameter 250*d* of the main seal 210*d* is slightly less than the seal diameter 252*d* of the valve mechanism 65*d* and the effective diameter 255*d* of the of the test seal 215*d* is slightly greater than the seal diameter 252*d* of the valve mechanism 65*d*. In this way, the valve 10*d* can be di-directional whilst the sealing of the valve mechanism 65*d* and valve seat 70*d* is always boosted, regardless of the which way the pressure differential acts over the shuttle sleeve 205*d*. As the seal diameter 252*d* of the valve mechanism (poppet) 65*d*, the effective diameter 350*d* of the main seal 210*d* and the effective diameter 355*d* of the test seal 215*d* are all close in size (albeit different, as indicated above), e.g. within 10%, then interference with operation of the main valve opening/closing mechanism responsive to operation of the pump 20 is minimised.

The operation of the valve 10*d* can be seen from FIGS. 12 to 17.

Figure 12:
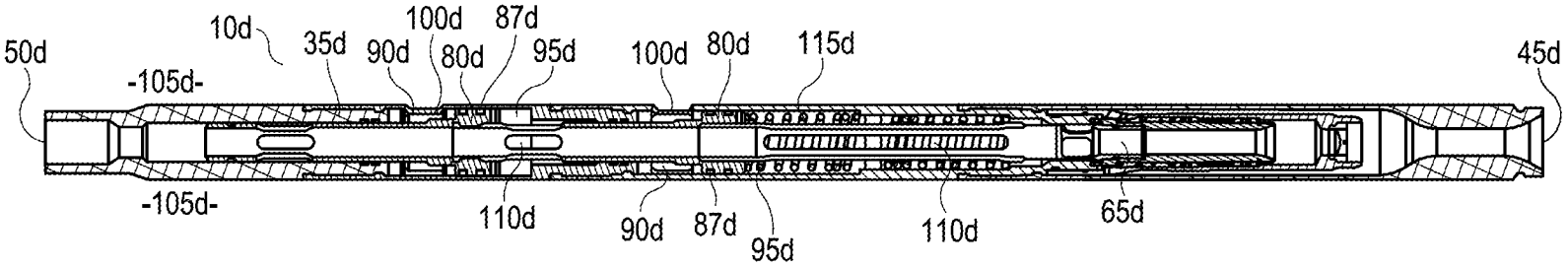
FIG. 12 is a cross sectional view of the pressure operated valve of FIG. 10 in a closed configuration.

FIG. 12 shows a cross sectional view of the valve 10*d* in a closed configuration. In this case, the pump 20 (FIG. 1) is either not operational or at least not operational to a level sufficient to overcome the force applied by the biasing member 115*d*. In this case, the pressure in the annulus 105*d* and thus the first chamber 90*d* is less than the pressure in the valve bore 55*d* and second chamber 95*d* and the piston members 80*d* are biased towards the left in FIG. 12.

Figure 13:
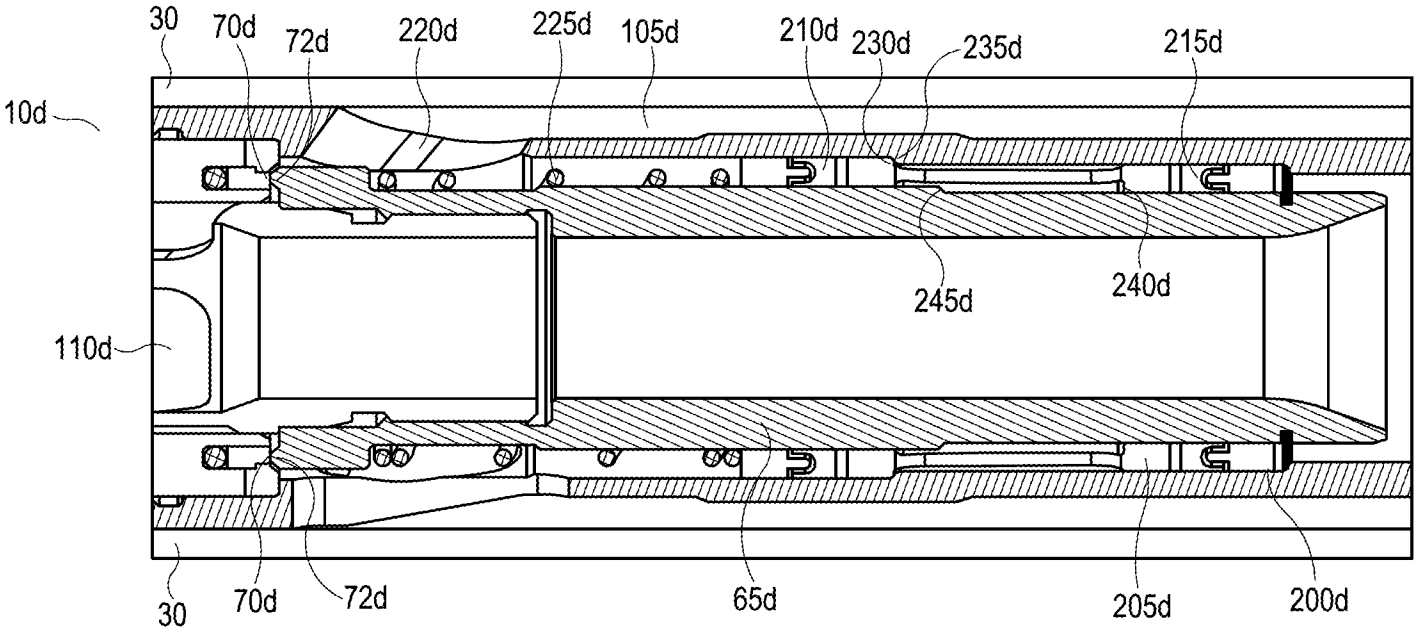
FIG. 13 is a detailed cross sectional view of the pressure operated valve of FIG. 10 in a closed configuration.

A detail cross sectional view of the further operating mechanism 200*d* in the closed configuration is shown in FIG. 13. In this case, no pressure is applied from the surface such that the wellbore pressure downhole of the valve 10*d* as seen at the valve inlet 45*d* and the main seal 210*d* via the through passage 220*d* in the housing is greater than the uphole pressure as seen by the test seal 215*d* via the valve bore 55*d* and valve outlet 50*d*. In this case, the wellbore pressure from downhole of the valve 10*d* acts across a differential piston area between the seal diameter 252*d* of the valve mechanism 65*d* (e.g. of the interface of the valve seat 70*d* against the sealing surface 72*d*) and the effective diameter 250*d* of the main seal 210*d*. As the seal diameter 252*d* of the valve mechanism 65*d* is greater than the effective diameter 250*d* of the main seal 210*d*, the valve mechanism 65*d* is forced such that the sealing surface 72*d* and the valve seat 70*d* are further forced together, thus boosting the seal. The shuttle sleeve 205*d* stays right in FIGS. 12 and 13 such that the first loading shoulder 240*d* is engaged with the first loading surface 245*d* due to the pressure from downhole via the through passage 220*d* and the biasing member 225*d*.

Figure 14:
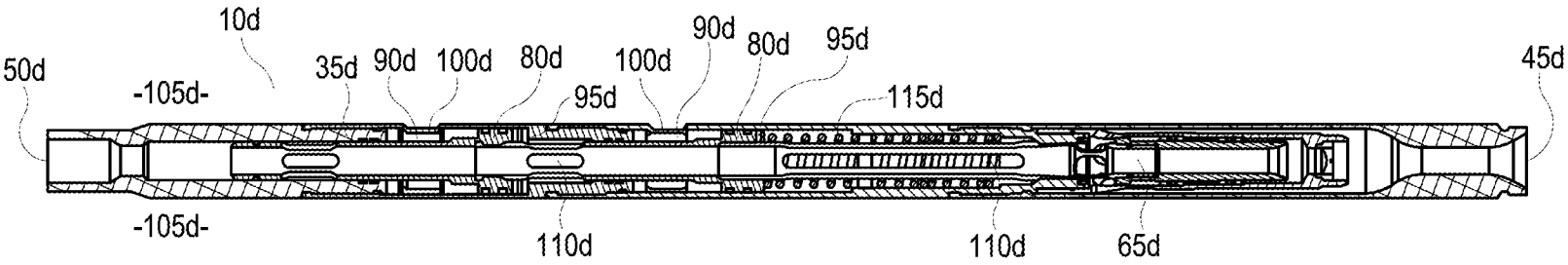
FIG. 14 is a cross sectional view of the pressure operated valve of FIG. 10 in an open configuration.
Figure 15:
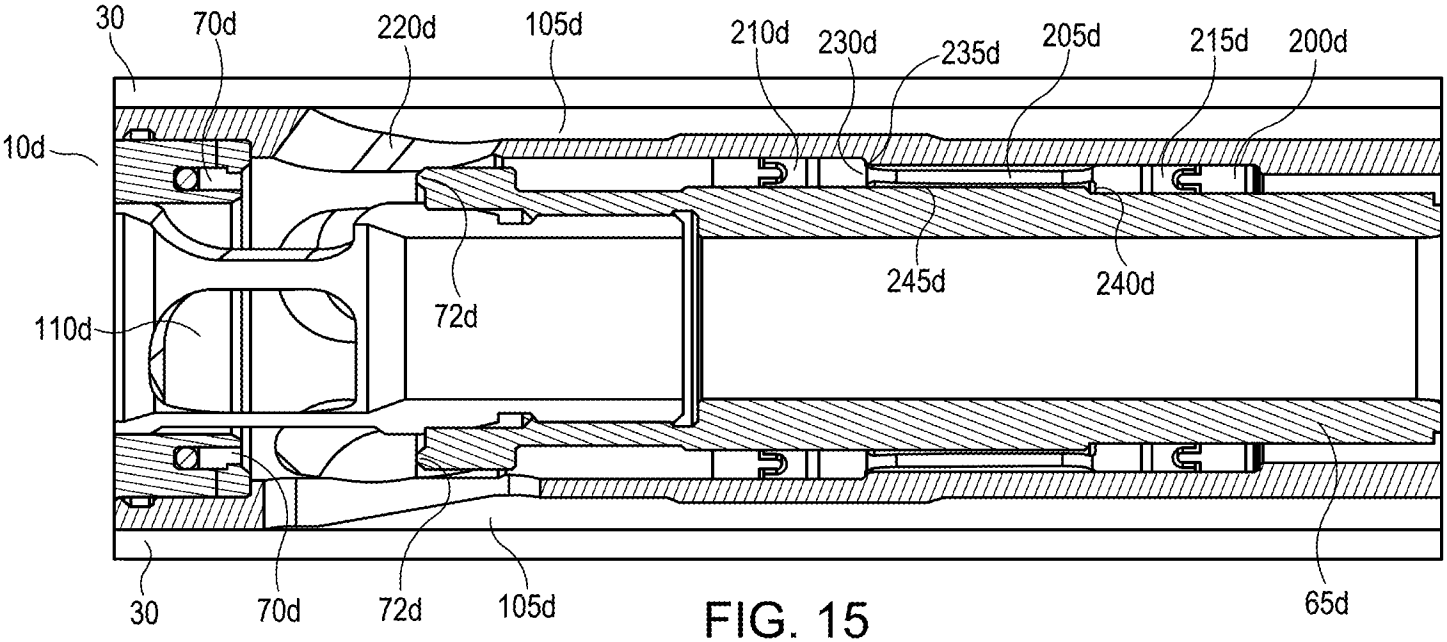
FIG. 15 is a detailed cross sectional view of the pressure operated valve of FIG. 10 in an open configuration.

FIGS. 14 and 15 show cross sectional views of the valve 10*d* in an open configuration. In this case, the pump 20 (FIG. 1) is operating such that the pressure in the valve bore 55*b* and thereby the second chamber 95*d* is reduced by the pump via the valve outlet 50*d* and the pressure in the annulus 105*d* and thereby the first chamber 90*d* is increased relative to the situation shown in FIGS. 12 and 13. In this case, the pressure differential created by operation of the pump 20 causes the piston members 80*d* to move right in FIG. 14 to overcome the biasing member 155*d* and move the valve mechanism (poppet) 65*d* and the sealing surface 72*d* of the valve mechanism 65*d* off the valve seat 70*d* to open the valve 10*d*.

However, in this case, the shuttle sleeve 205*d* remains right in FIGS. 14 and 15 such that the first loading shoulder 240*d* is engaged with the first loading surface 245*d* due to the pressure from downhole via the through passage 220*d* and the action of the biasing member 225*d*.

Figure 16:
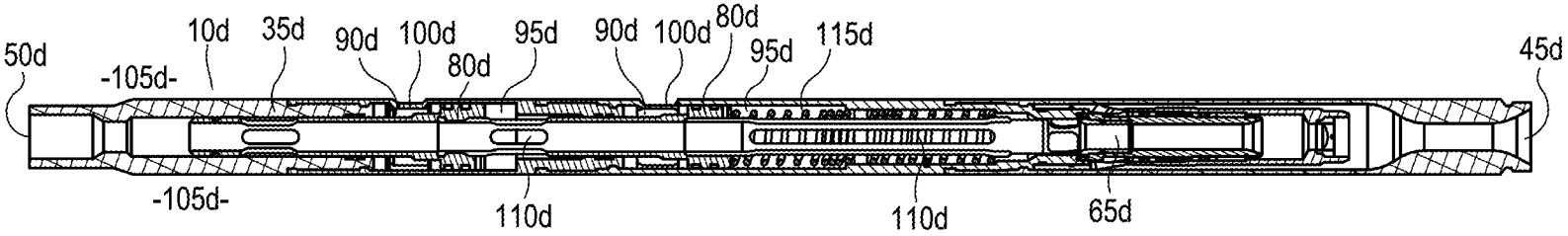
FIG. 16 is a cross sectional view of the pressure operated valve of FIG. 10 in a test configuration.
Figure 17:
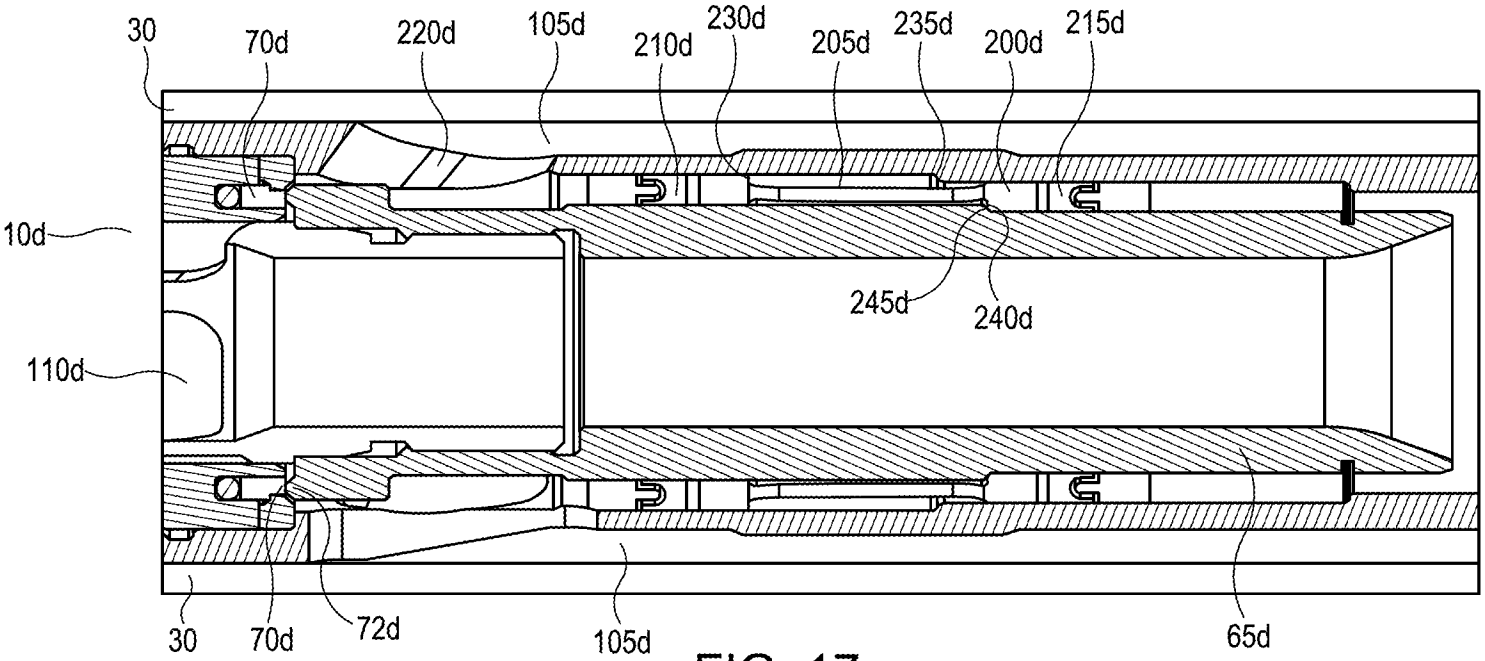
FIG. 17 is a detailed cross sectional view of the pressure operated valve of FIG. 10 in a test configuration.

FIGS. 16 and 17 show cross sectional views of the valve 10*d* in a test configuration in which the shuttle sleeve 205*d* is moved, thereby opening the valve 10*d* to reverse flow from the uphole side (outlet 50*d*) to the downhole side (the inlet 45*d*). In this case, an uphole pressure has been applied from the surface or other uphole location down to the valve outlet 50*d*, and thereby to the valve bore 55*d* and the test seal 215*d*. The uphole pressure that was applied acts across a differential piston area between the seal diameter 252 of the valve mechanism 65*d* and the effective diameter 255*d* of the test seal 215*d*. As the effective diameter 255*d* of the test seal 215*d* is larger than the seal diameter 252 of the valve mechanism 65*d*, this acts to boost the sealing of the sealing surface 72*d* of the valve mechanism 65*d* against the valve seat 70*d* whilst at the same time operating the shuttle sleeve 205*d* to the left as shown in FIGS. 16 and 17 so that the second loading shoulder 245*d* is pushed towards and eventually engages with the second loading surface of the valve mechanism 65*d*. The effect of this is to open the valve 10*d* up to reverse flow whilst further boosting the seal of the valve seat 70*d* and sealing surface 72*d*.

The arrangement described above may provide certain benefits. The valve can be made selectively bi-directional, whilst the sealing of the valve mechanism 65*d* is boosted regardless of the direction of the pressure differential across the shuttle sleeve 205*d*. This arrangement also minimises the number of seals required, there is no trapped pressure between the main seal 210*d* and test seal 215*d* and volume change is reduced or minimised due to the moving shuttle sleeve 205*d* The shuttle sleeve 205*d* allows the main seal 210*d* and test seal 215*d* themselves to load out onto one of the loading surfaces 240*d*, 250*d* and also means that low friction dynamic seals. 210*d*, 215*d* can be used. The particular design of the shuttle sleeve 205 allows the possibility of adjusting the biasing force due to pressure independent of the seal 210*d*, 215*d* minimum wall section, or can adjust it to be different in each direction. This arrangement allows the valve 10*d* to be testable from the surface or to act as a bi-directional valve such as a fluid loss valve, a barrier valve, or the like.

Figure 19:
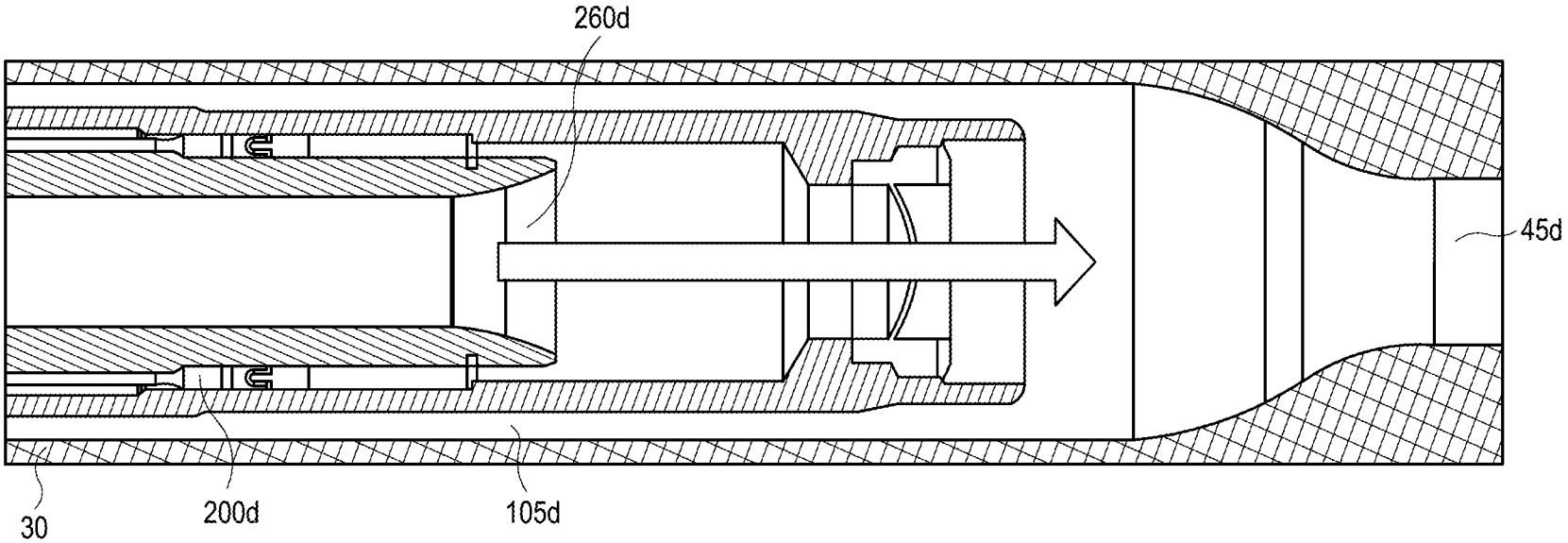
FIG. 19 is a cross sectional view of the pressure operated valve of FIG. 10 with a burst valve opened.

Beneficially a pressure operated valve opening mechanism 260*d* such as a burst disc, plug with O-ring seal, or ball seat, or plug with shear screws, a shear ring, a detent ring or a detent spring or the like could be used. The pressure operated valve opening mechanism 260*d* is operable under pressure differential applied from uphole, e.g. from the surface, to rupture or shear the opening mechanism 260*d* to allow access through the valve 10*d*, as shown in FIG. 19.

For example, although examples of valve mechanisms that comprise a poppet valve and a sliding sleeve valve are given above, it will be appreciated that other valve types such as flapper valves, ball valves and the like could be used. Furthermore, although various mechanisms for resisting, preventing or desensitizing the valve to operation by a valve inlet to valve outlet pressure differential or simply being such that the valve is unaffected by the valve inlet to valve outlet pressure differential (rather than a pressure differential caused by the operation of the pump, such as an annulus to valve bore/valve outlet/pump inlet pressure differential) are described above, it will be appreciated that other suitable mechanisms could be used and may be apparent from the present disclosure. As the apparatus functions by the creation of a differential pressure at a set depth, this can be used advantageously in any system whereby a pressure differential between the inside of the conduit and production tubing exists during operation. Alternatively, in the case of rod lift or PCP systems, a differential pressure can be exerted during the mechanical action of the solid rods by rotation and/or lifting.

Furthermore, although some of the examples described above comprise a single piston member 80*a*, 80*b*, 80*c*, the valve 10 could instead be provided by a plurality of piston members. In this case, each piston member could be provided between respective or common first chambers 90 and second chambers 95, such that each piston member experiences the pressure differential between the annulus 105 pressure and the combination of the valve bore 55*a* pressure and force applied by the biasing member 115. In this way, the combined force applied on the piston members due to the pressure differential and thereby on the valve mechanism in opposition to the force applied by the biasing member 115 can be made greater than that applied by a single piston member.

In addition, whilst various sealing mechanisms are described, such as O-rings, other sealing mechanisms could be used, such as rolling membranes, bellows, concertina seals and/or the like.

As such, while certain embodiments have been described, these embodiments have been presented by way of example only, and are not intended to limit the scope of the invention. Indeed the novel methods and systems described herein may be embodied in a variety of other forms. Furthermore, various omissions, substitutions and changes in the form of the methods and systems described herein may be made without departing from the spirit of the invention. The accompanying claims and their equivalents are intended to cover such forms and modifications as would fall within the scope of the invention.

The invention claimed is:

1. A downhole valve for location in a tubular, the downhole valve comprising:
- a housing;
- a flow path between a valve inlet and a valve outlet;
- at least one valve mechanism; and
- at least one piston member;
- wherein:
  - the at least one valve mechanism is operable by actuation of the at least one piston member to selectively open and close the flow path between the valve inlet and valve outlet;
  - the at least one piston member is actuatable to selectively open and close the flow path between the valve inlet and valve outlet by a pressure differential between an annulus pressure at the valve and a pressure at the valve outlet, and
  - the annulus is defined between the valve and the tubular in which the valve is located.

2. The downhole valve of claim 1, wherein at least one of:
- operation of the valve mechanism to at least one of open or close the flow path is unaffected by the pressure applied at the valve inlet, or
- the downhole valve is configured such that the valve mechanism is not operable to at least one of open or close the flow path by changes in pressure at the valve inlet alone.

3. The downhole valve of claim 1, wherein:
- the valve outlet is configured to be in fluid communication with a downhole pump or other artificial lift system that is provided uphole of the downhole valve, in use, and the pump or other artificial lift system is operable to vary at least one of the pressure at the valve outlet or the differential between an annulus pressure at the valve and a pressure at the valve outlet to thereby actuate the at least one valve mechanism.

4. The downhole valve of claim 1, wherein the annulus is or comprises a volume that is radially outwardly of the valve, between the valve and the tubular in which the valve is located, in use.

5. The downhole valve of claim 1, comprising an opening for receiving the annular pressure to actuate the piston member that is isolated from the valve inlet and valve outlet.

6. The downhole valve of claim 1, comprising:

at least one first pressure chamber in fluid communication with the annulus and isolated from the flow path from the valve inlet to the valve outlet; and at least one second pressure chamber, in fluid communication with the valve outlet, wherein each of the at least one first pressure chambers are separated from each of the at least one second pressure chambers by one of the at least one piston members, respectively.

7. The valve according to claim 1, wherein the valve mechanism comprises a sliding sleeve, a poppet, a ball, or a flapper.

8. The valve according to claim 1, comprising a resiliently deformable member configured to at least one of bias the piston member against the pressure from the annulus or bias the valve mechanism into the closed configuration.

9. The valve according to claim 8, wherein the resiliently deformable member is configured to bias the valve mechanism towards or against the pressure at the inlet or against being operated by a pressure differential between the valve inlet and valve outlet.

10. The valve according to claim 1, wherein one or more of the valve mechanisms comprises a downhole or valve inlet end surface and a sloping face that extends obliquely radially outwardly from the downhole or valve inlet end surface of the valve mechanism, such that a diameter of the downhole or valve inlet end surface of the valve mechanism is less than a diameter of the valve mechanism at the other end of the sloping face.

11. The valve according to claim 1, wherein the valve mechanism comprises a sub-chamber located uphole of the downhole or inlet end face and the sloping face and within the valve mechanism, wherein the sub-chamber is in fluid communication with a downstream or uphole or annulus pressure and the first pressure chamber.

12. The valve according to claim 1, wherein the valve mechanism defines a through passage from an inlet end of the valve mechanism to an outlet end of the valve mechanism and the valve comprises a feed passage in fluid communication between the valve inlet and a feed passage outlet, wherein at least one of:

the feed passage outlet faces a side wall of the valve mechanism when the valve mechanism is in a closed configuration; or at least of the feed passage outlet or a portion of the feed passage immediately adjacent at least one of the feed passage outlet and the flow of fluid therein is perpendicular, angled or oblique to a direction of motion of the valve mechanism.

13. The valve according to claim 1, configured such that, when in the open configuration, there is a pressure drop across the valve.

14. The valve according to claim 1, wherein the valve comprises a plurality of piston members configured such that fluid from the valve inlet applies a force on at least one of the piston members that opposes the force applied on at least one other of the piston members.

15. The valve according to claim 14, wherein the fluid from the valve inlet applies a force on the at least one of the piston members in a direction so as to close the at least one valve mechanism and applies a force on the at least one other of the valve mechanisms in a direction so as to open the at least one other of the valve mechanisms, wherein the force on the at least one of the piston members is the same as the force on the at least one other piston member and the differential between the force on the at least one of the piston members and the force on the at least one other piston member is less than a biasing force applied by the resiliently deformable member.

16. The valve according to claim 15, wherein a valve outlet side surface area or diameter of the at least one piston member is different to a valve outlet side surface area or diameter of the at least one other piston member.

17. The valve according to claim 1, wherein the valve is a bi-directional valve and is configured to be remotely operable by pressure supplied from the remote location into a configuration in which the downhole device allows fluid flow through the downhole device from uphole to downhole and operable by operation of the pump into a configuration in which the downhole device allows fluid flow through the downhole device from downhole to uphole.

18. The valve according to claim 17, comprising an operating mechanism that is configured to receive pressure from the remote location to selectively open or close the flowpath, the operating mechanism comprising a shuttle sleeve and a plurality of seals, the shuttle sleeve being configured to receive pressure from downhole at one of the seals and pressure from uphole at an other of the seals.

19. The valve of claim 18, wherein the seals are unidirectional seals, wherein the seal that receives pressure from downhole is configured to resist the pressure from downhole whilst the seal that receives the pressure from uphole is configured to resist the pressure from uphole.

20. The valve of claim 18, wherein at least one of:

the effective diameter or inner diameter of the seal of the other operating mechanism that receives the pressure from downhole is less than a seal diameter of the at least one valve mechanism; or the effective diameter or outer diameter of the seal of the other operating mechanism that receives the pressure from the remote location is greater than the seal diameter of the at least one valve mechanism.

21. A downhole assembly comprising:

the valve of claim 1; and a pump or other artificial lift system; and a packer.

22. The assembly of claim 21, wherein at least part of the valve is coupled to between the pump and the packer such that at least part of the valve is uphole of the packer and downhole of the pump, in use.

23. The assembly of claim 21, wherein:

the packer comprises a support member that defines a through bore and a sealing element for sealing between the support member and the wall of the wellbore, casing, liner or outward tube so as to close the annulus;

the valve inlet is arranged to receive fluid from downhole of the sealing element in use; and the pump is configured to pump fluid from the valve outlet of the valve into the annulus uphole of the sealing element.

24. The assembly of claim 23, wherein the pump is configured so as to at least one of create or vary the pressure differential between the annulus and the valve outlet and/or the flow channel in the valve and create or vary the pressure differential between the first pressure chamber and the second pressure chamber of the valve by selectively pumping fluid from the valve outlet of the valve into the annulus uphole of the packer.

25. The assembly of claim 24, wherein the pump is configured to open the valve by pumping fluid from the valve outlet of the valve into the annulus uphole of the packer; and configured to close the valve by reducing or stopping the pumping of fluid from the valve outlet of the valve into the annulus uphole of the packer.

26. An assembly comprising:

a downhole pump; and a pressure actuated downhole valve, wherein the valve comprises:

a housing;

a flow path between a valve inlet and a valve outlet;

at least one valve mechanism; and at least one piston member;

wherein:

the at least one valve mechanism is operable by actuation of the at least one piston member to selectively open and close the flow path between the valve inlet and valve outlet; and the at least one piston member is actuatable to selectively open and close the flow path between the valve inlet and the valve outlet by a pressure differential at the valve outlet produced by the pump.

27. The assembly of claim 26, wherein the pressure differential produced by the pump is a pressure differential between an annulus pressure at the valve and a pressure at the valve outlet.

28. A method of operating the assembly of claim 21, wherein the method comprises at least one of:

controlling the pump or other artificial lift system so that the pump or other artificial lift system operates above a threshold so as to cause a pressure differential between the annulus and the valve outlet or a pressure at a valve outlet, to thereby actuate the valve mechanism so as to open the flow path through the valve; or controlling the pump or other artificial lift system so that the pump or other artificial lift system is inactive or operating below the threshold so as to reduce or remove the pressure differential between the annulus and a valve outlet, flow path or second pressure chamber of the valve, or to increase the pressure at the valve outlet to thereby actuate the valve mechanism so as to close the flow path.

* * * * *